US008511781B2

(12) United States Patent
Yamamoto et al.

(10) Patent No.: US 8,511,781 B2
(45) Date of Patent: Aug. 20, 2013

(54) PRINTING APPARATUS HAVING MOVABLE SENSOR AND METHOD FOR USING

(75) Inventors: Kosuke Yamamoto, Yokohama (JP); Kazuhisa Kawakami, Yokohama (JP); Kenji Shigeno, Yokohama (JP); Noriyuki Aoki, Tokyo (JP); Yuji Kanome, Yokohama (JP); Masakazu Tsukuda, Tokyo (JP); Haruo Uchida, Yokohama (JP); Hiroyuki Saito, Yokohama (JP); Yoshiaki Suzuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 12/558,182

(22) Filed: Sep. 11, 2009

(65) Prior Publication Data

US 2010/0066782 A1 Mar. 18, 2010

(30) Foreign Application Priority Data

Sep. 16, 2008 (JP) ..... 2008-236776

(51) Int. Cl.
*B41J 29/38* (2006.01)
*B41J 29/393* (2006.01)

(52) U.S. Cl.
USPC ..... 347/16; 347/19

(58) Field of Classification Search
USPC ..... 347/16
See application file for complete search history.

(56) References Cited

U.S. PATENT DOCUMENTS

| | | | | |
|---|---|---|---|---|
| 4,860,026 | A * | 8/1989 | Matsumoto et al. | 347/15 |
| 5,870,114 | A * | 2/1999 | Numata et al. | 347/16 |
| 7,104,710 | B2 | 9/2006 | Otsuka | |
| 7,147,316 | B2 * | 12/2006 | Hayashi et al. | 347/104 |
| 2002/0113363 | A1 * | 8/2002 | Yanagi et al. | 271/264 |
| 2005/0024415 | A1 * | 2/2005 | Claramunt et al. | 347/19 |
| 2008/0240820 | A1 * | 10/2008 | deJong et al. | 399/395 |
| 2009/0003854 | A1 * | 1/2009 | Naoi et al. | 399/38 |
| 2010/0134551 | A1 * | 6/2010 | Kawakami et al. | 347/16 |

FOREIGN PATENT DOCUMENTS

| | | | |
|---|---|---|---|
| JP | 56037945 | A * | 4/1981 |
| JP | 2003312896 | A * | 11/2003 |
| JP | 2007130933 | A * | 5/2007 |

OTHER PUBLICATIONS

Machine generated English translation of Japanese patent document JP 2003-312896 "Sheet Carrying Device" to Michiki Yozo; translation generated via http://www19.ipdl.inpit.go.jp/PA1/cgi-bin/PA1INDEX on Mar. 8, 2012; 8 pp.*

* cited by examiner

*Primary Examiner* — Shelby Fidler
(74) *Attorney, Agent, or Firm* — Canon USA, Inc., IP Division

(57) ABSTRACT

A printing apparatus including a conveyance mechanism configured to convey a sheet in a predetermined direction, a printing unit configured to print an image on the sheet, a direct sensor having an image pickup device configured to image the sheet, which is used to sense movement of the sheet by signal processing of an output from the image pickup device, a movement mechanism configured to move the image pickup device in a direction including a component of the predetermined direction, and a control unit configured to control the conveyance mechanism, the printing unit, and the movement mechanism.

19 Claims, 25 Drawing Sheets

PRINTING APPARATUS HAVING MOVABLE SENSOR AND METHOD FOR USING

BACKGROUND OF THE INVENTION

1. Field of the Invention

The present invention relates to a printing apparatus, for example to an inkjet printing apparatus which prints by discharging a liquid such as ink.

2. Description of the Related Art

In inkjet printing apparatuses, to realize a high-quality image, a high conveyance accuracy of a sheet-like printing media (in the present specification, simply referred to as a "sheet") is required. Recently, to control conveyance with a higher degree of accuracy, direct sensors are being realized which directly detect a movement amount of the sheet by imaging the sheet surface and then performing image processing. For example, U.S. Pat. No. 7,104,710 discusses a technique for controlling conveyance by using a direct sensor. In the apparatus discussed in that document, the direct sensor is provided on a carriage which mounts a print head, or at a position facing a discharge port surface of the print head.

However, in this configuration the sheet can only be imaged at a position where the direct sensor is fixed in the sheet conveyance direction. Therefore, during sheet conveyance, the sheet may not be present at a sensing position of the direct sensor in a certain period (hereinafter, referred to as "sensing disabled period"). For example, in a case where an image is printed by a multipass method during printing on a trailing edge or a leading edge of the sheet, if the sheet edge portion deviates from the sensing position during printing, thereby making sensing impossible, conveyance cannot be controlled with a high degree of accuracy. As a result, there is the problem that the quality of that portion cannot be guaranteed.

SUMMARY OF THE INVENTION

The present invention is directed to a printing apparatus. More specifically, the present invention is directed to a printing apparatus which can reduce the sensing disabled period of the direct sensor.

According to an aspect of the present invention, a printing apparatus includes a conveyance mechanism configured to convey a sheet in a predetermined direction, a printing unit configured to print an image on the sheet, a direct sensor having an image pickup device configured to image the sheet, which is used to sense movement of the sheet by signal processing of an output from the image pickup device, a movement mechanism configured to move the image pickup device in a direction including a component of the predetermined direction, and a control unit configured to control the conveyance mechanism, the printing unit, and the movement mechanism.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
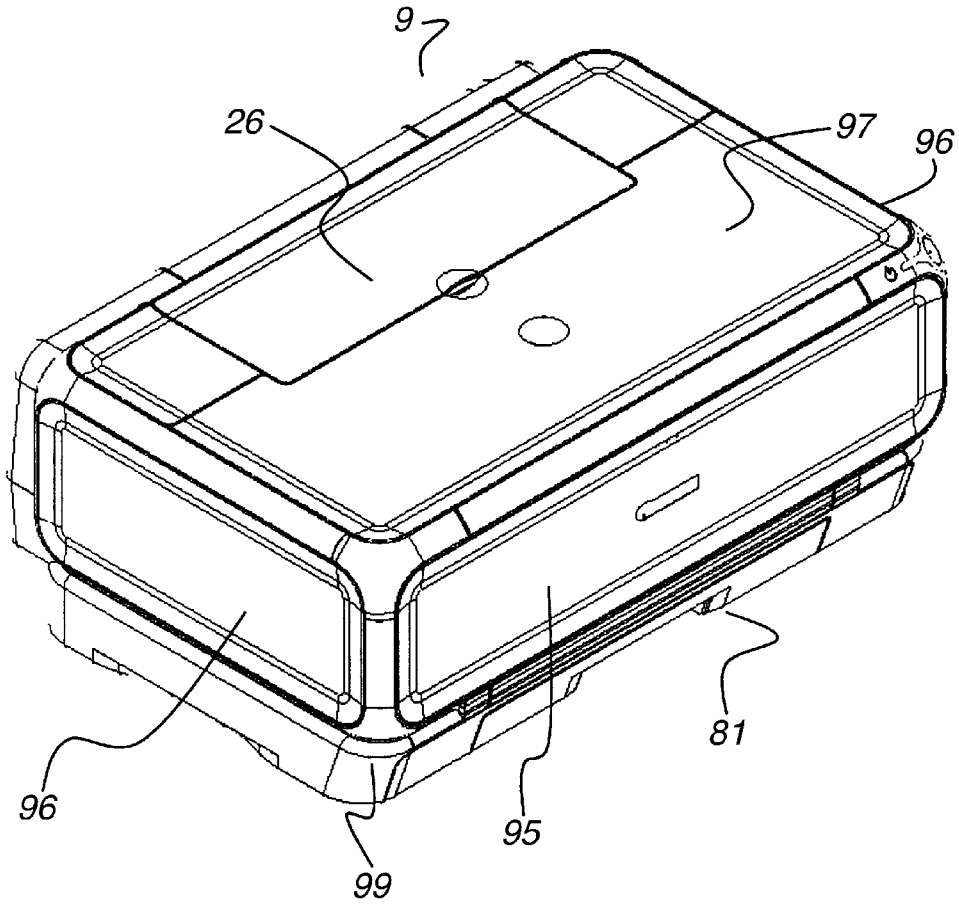
FIG. 1 is a perspective view illustrating an appearance of a printing apparatus according to a first exemplary embodiment.
Figure 2:
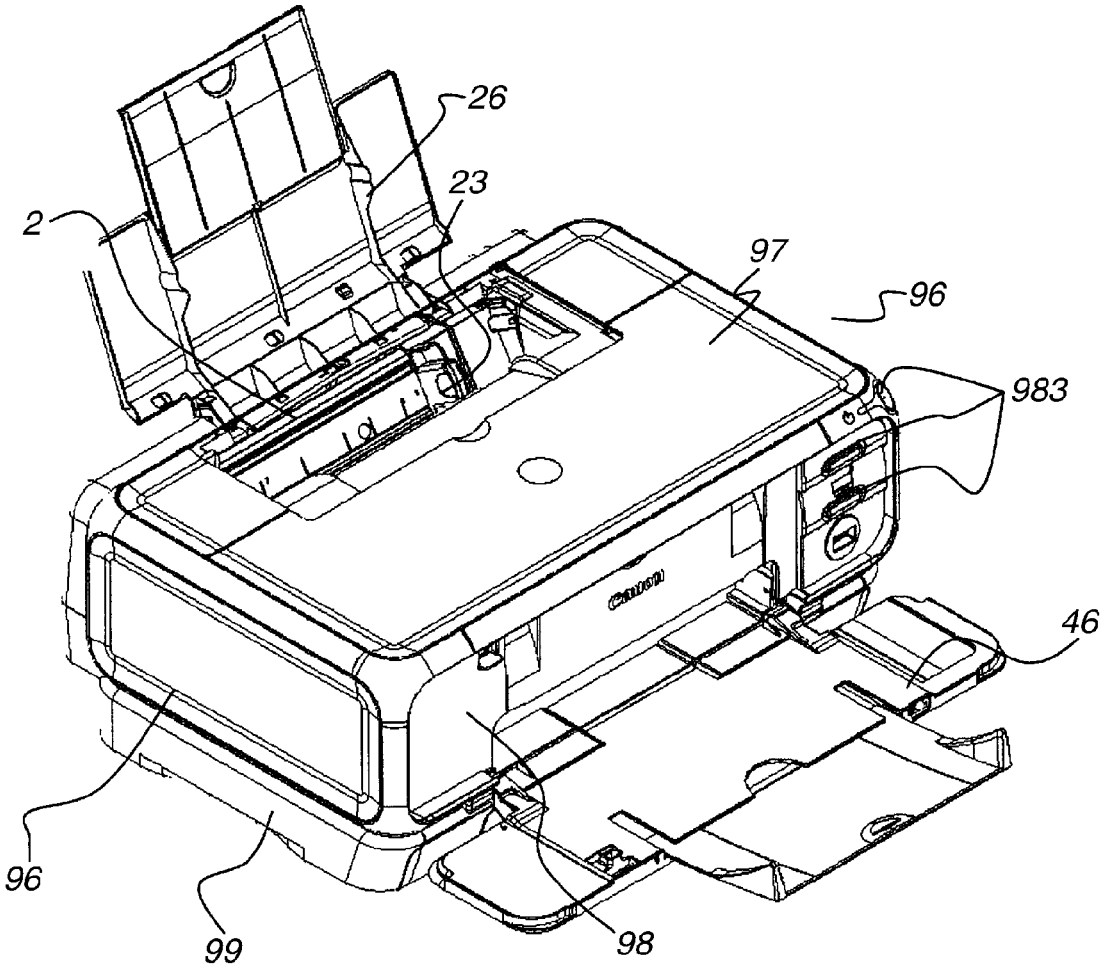
FIG. 2 is a perspective view of the printing apparatus.
Figure 3:
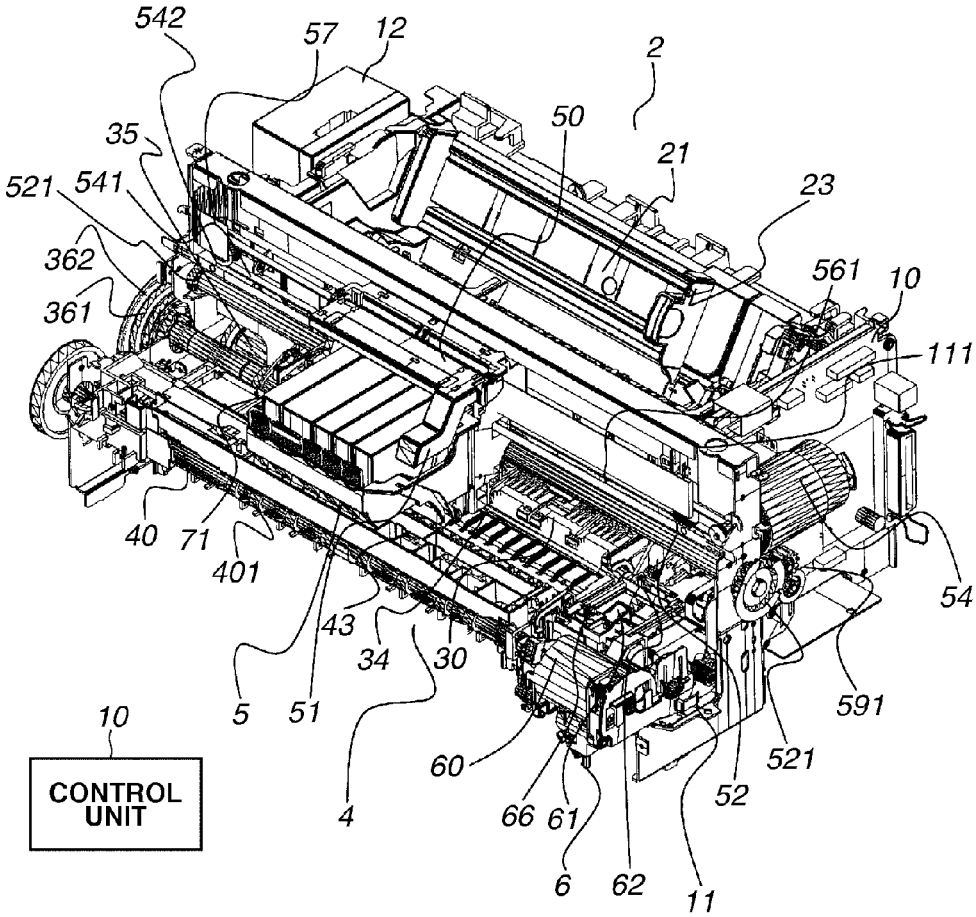
FIG. 3 is a perspective view of a mechanism unit.
Figure 4:
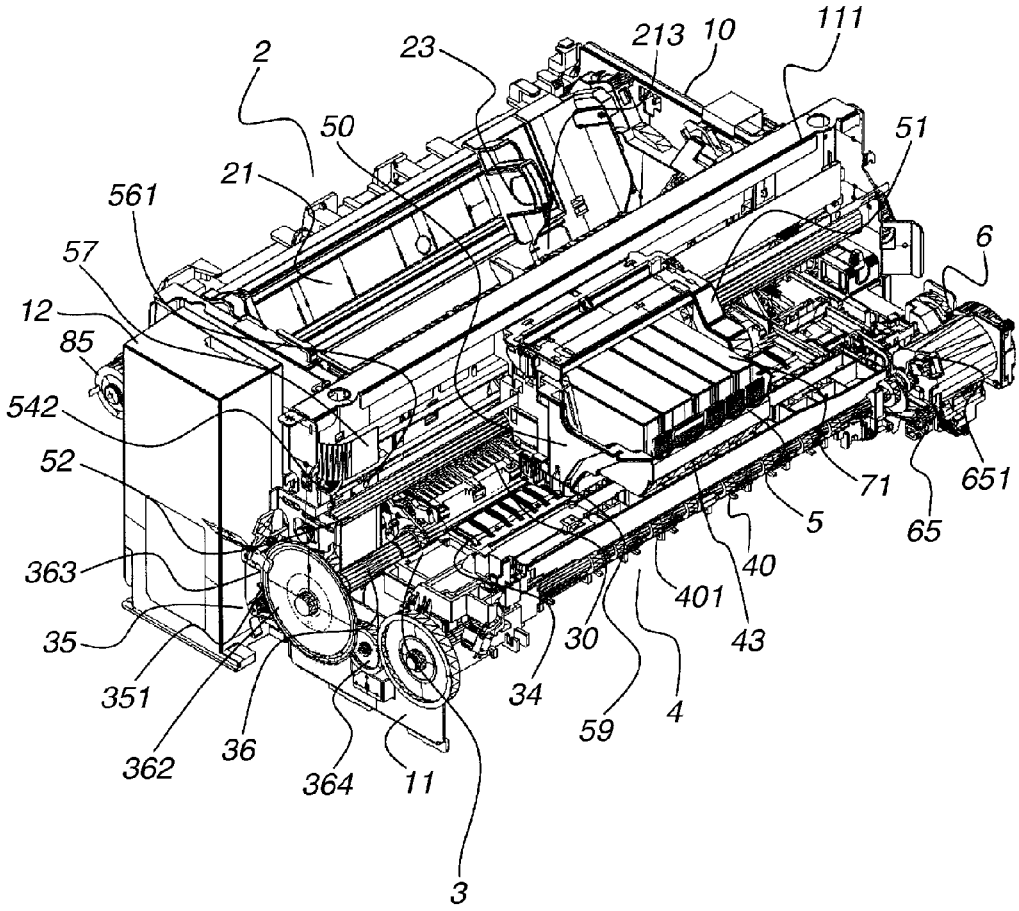
FIG. 4 is a perspective view of a mechanism unit.
Figure 5:
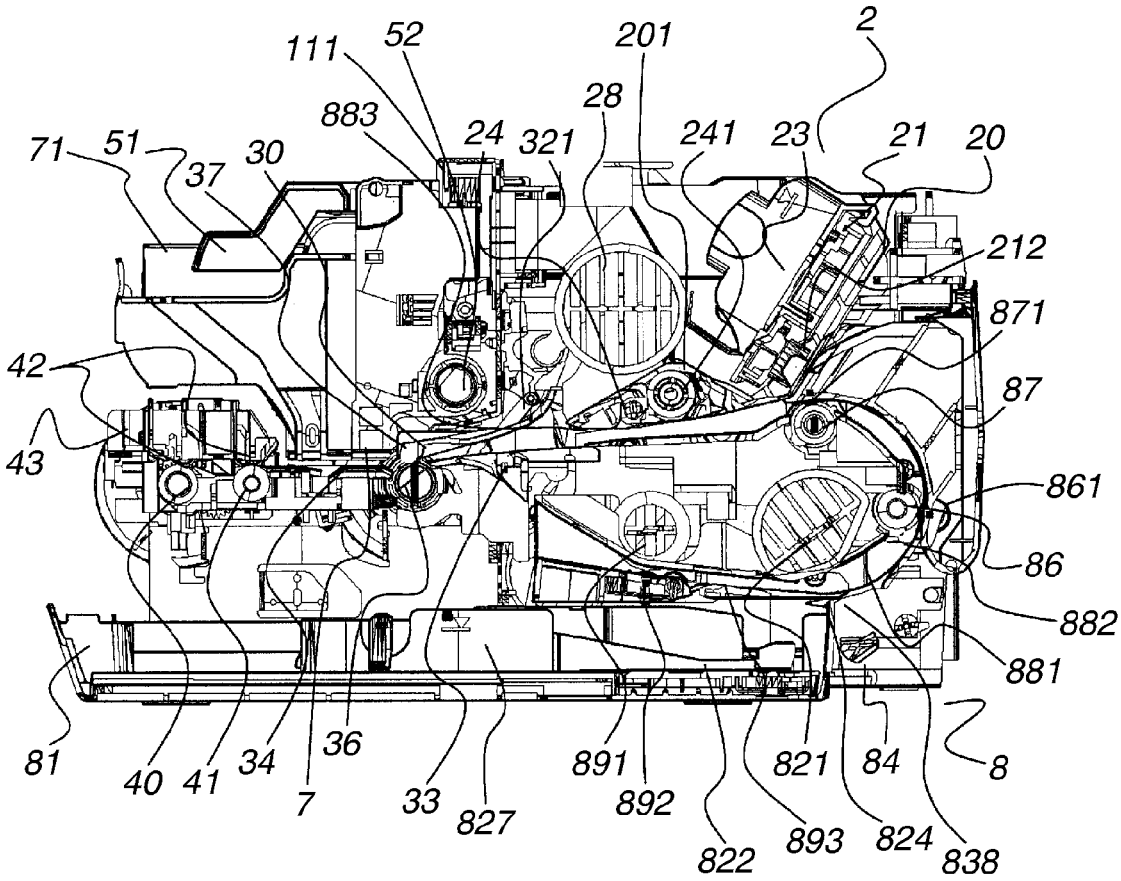
FIG. 5 is a cross-sectional view of a mechanism unit.

Various exemplary embodiments, features, and aspects of the invention will be described in detail below with reference to the drawings.

A first exemplary embodiment of the present invention will now be described while referring to FIGS. 1 to 12.

A printing apparatus according to the present exemplary embodiment includes a feeding unit 2, a conveyance unit 3, a carriage unit 5, a paper discharge unit 4, a U-turn/automatic two-sided conveying unit 8, a cleaning unit 6, a print head 7, an exterior 9, a controller 10, and a power source unit 12. Each of these components will be explained in order. In the present specification, the term "sheet" means various sheet-like articles, such as paper, plastic, film, metal plate and the like. Further, in the present specification, the terms "upstream" and "downstream" mean upstream or downstream with respect to the conveyance direction of the sheet when printing an image on the sheet.

The feeding unit 2 is configured with a pressure plate 21 for stacking sheets P, a feeding roller 28 for feeding sheets P, a separation roller 241 for separating sheets P, and a return lever 22 to return sheets P to a stack position. These parts are all attached to a base 20. A feed tray 26 for holding the stacked sheets P is mounted on the base 20. The feed tray 26 is a multistage type which is pulled out when used.

The feeding roller 28 is a rod having an arcuate cross section. The feeding roller 28 is provided with a feeding roller rubber near a sheet reference position to feed the sheets P. A motor installed in the feeding unit 2 and commonly used also by the cleaning unit 6 (hereinafter referred to as "AP motor") transmits a drive force to the feeding roller 28 by a drive force transmission gear. A rotary type encoder is provided on the same shaft as the motor, and the rotation amount and speed of the motor are controlled based on an encoder signal.

The pressure plate 21 has a movable side guide 23 which limits the stack position of the sheets P. The pressure plate 21 is rotatable about a rotating shaft coupled to the base 20 and is urged by a pressure plate spring 212 toward the feeding roller 28. A part of the pressure plate 21 facing the feeding roller 28 is provided with a separation sheet 213 which is formed from a material having a large friction coefficient to prevent duplicate sheets P from being fed at one time near the end of stacking. The pressure plate 21 can engage with and disengage from the feeding roller 28 by a pressure plate cam.

A separation roller holder 24 mounted with the separation roller 241 to separate sheets P one at a time is rotatably mounted about a rotating shaft provided on the base 20. The separation roller holder 24 is urged toward the feeding roller 28 by a separation roller spring. The separation roller 241 has a clutch spring that allows a portion to which the separation roller 241 is attached to rotate when a predetermined load or more is applied. The separation roller 241 can engage with and disengage from the feeding roller 28. The positions of the pressure plate 21 and the separation roller 241 are detected by an auto sheet feeder (ASF) sensor.

The conveyance unit 3 is mounted on a chassis 11. The conveyance unit 3 has a conveyance roller 36 for conveying sheets P in a predetermined direction (first direction). The conveyance roller 36 is configured so that the metal portions of both shafts are mounted on the chassis 11 through bearings. To assure stable conveyance by applying a load on the conveyance roller 36 when it is rotating, a tension spring is provided between the bearings and the conveyance roller 36, whereby a predetermined load is applied by urging the conveyance roller 36.

The conveyance roller 36 is engaged with a plurality of driven pinch rollers 37. The pinch rollers 37 are held in a pinch roller holder 30. The pinch rollers 37 are urged by a pinch roller spring so as to press against the conveyance roller 36 to generate a sheet P conveyance force. At this stage, the rotating shaft of the pinch roller holder 30 is mounted on the bearing of the chassis 11, around which the pinch roller holder 30 rotates.

At an entrance of the conveyance unit 3 to which the sheets P are conveyed, a paper guide flapper 33 for guiding the sheets P and a platen 34 are installed. The pinch roller holder 30 is provided with a PE sensor lever 321 which transmits detection of the leading edge and trailing edge of the sheet P to the PE sensor. This PE sensor is an optical sensor. The platen 34 is mounted and positioned on the chassis 11. The paper guide flapper 33 can engage with the conveyance roller 36 and rotate around the conveyance roller 36. The paper guide flapper 33 is positioned by engaging with the chassis 11.

In the above-described configuration, the sheet P fed to the conveyance unit 3 is guided by the pinch roller holder 30 and the paper guide flapper 33 and fed between the conveyance roller 36 and the pinch rollers 37. The PE sensor lever 321 detects the leading edge of the fed sheet P, and based on this detection, a print start position of the sheet P is determined. The sheet P is conveyed over the platen 34 by the rollers 36 and 37 being rotated by a conveyance motor 35. The rotation force of the conveyance motor 35, which is configured by a DC motor, is transmitted to a pulley 361 arranged on the shaft of the conveyance roller 36 by a timing belt 351 to apply a drive force on the conveyance roller 36. On the shaft of the conveyance roller 36 is provided a code wheel 362, which is marked at 150 to 300 lines per inch (lpi) for detecting a conveyance amount by the conveyance roller 36. An encoder sensor 363 that reads these marks is mounted on the chassis 11, which is positioned adjacent to the code wheel 362. The rotary encoder for detecting rotation of the conveyance roller 36 is configured by the code wheel 362, the encoder sensor 363, and a signal processing unit.

The carriage unit 5 has a carriage 50 for mounting the print head 7. A printing unit is configured by the carriage 50 and the print head 7. The print head 7 is an inkjet print head mounted with ink tanks of different color inks which can be replaced individually. This print head 7 discharges the ink from a nozzle by applying heat to the ink by a heater. The print head 7 is not limited to a method which uses a heater. The print head 7 may use another inkjet method, such as a piezoelectric element, an electrostatic element, a micro electro mechanical systems (MEMS) element or the like. Further, the print head is not limited to an inkjet head method. The print head may employ a thermal printing method, such as heat sublimation type or thermal printing type, or some other printing method.

The carriage 50 reciprocally moves in a second direction which intersects (here, in an orthogonal direction to) the conveyance direction of the sheet P, which is the first direction. The carriage 50 is supported by a guide shaft 52 and a guide rail 111. The guide rail 111 holds the trailing edge of the carriage 50, and maintains a gap between the print head 7 and the sheet P. The guide shaft 52 is mounted on the chassis 11. The guide rail 111 is integrally formed with the chassis 11.

The carriage 50 is driven by a carriage motor 54 mounted on the chassis 11 via a timing belt 541. The timing belt 541 is tensioned and supported by an idle pulley 542. The timing belt 541 is coupled to the carriage 50 via a damper made of rubber. The timing belt 541 alleviates image unevenness by damping oscillations of the carriage motor 54.

A code strip 561 marked at a pitch of 150 to 300 lpi to detect the position of the carriage 50 is provided parallel with the timing belt 541. An encoder sensor for reading the code strip 561 is provided on a carriage board, which is mounted on the carriage 50. On the carriage board, a contact for electrically connecting to the print head 7 is provided. The carriage 50 is provided with a flexible circuit board 57 for transmitting a head signal from an electric circuit board 1 to the print head 7.

In order to fix the print head 7 to the carriage 50, the carriage 50 is provided with an abutting portion for positioning and a pressing unit for pressing and fixing. The pressing unit is mounted on a headset lever 51. The pressing unit is configured to act on the print head 7 when the head set lever 51 is rotated around a rotation fulcrum to set the print head 7. An eccentric cam 521 is provided at both ends of the guide shaft 52, which enables the guide shaft 52 to be moved up and down by transmitting a driving force to the eccentric cam 521 via a gear train 591 from a main cam 63 of the cleaning unit 6. This configuration allows the carriage 50 to move up and down so as to provide an optimum gap for sheets P of different thickness.

The carriage 50 is mounted with a direct sensor 59 for detecting the leading edge position of the sheet P fed up to the print start position, and the sheet conveyance amount and movement speed during printing. The leading edge position and movement of the sheet can be sensed by the direct sensor 59 illuminating the sheet P by a semiconductor laser light-emitting element, imaging the illuminated region (image capturing position) by an image pickup device, and processing a signal from the image pickup device. The direct sensor 59 will be described in more detail below.

When forming an image on the sheet P, the rollers 36 and 37 convey the sheet P one step at a time in the first direction (sub-scanning). Simultaneously with this, the carriage 50 moves in the second direction (main scanning) by a carriage motor 80. This sub-scanning and main scanning are alternately repeated. In synchronization with the main scanning, the print head 7 discharges ink to form an image on a printing surface of the sheep P.

The paper discharge unit 4 is configured by two discharge rollers 40 and 41, spurs 42 which are pressed against the discharge rollers 40 and 41 at a predetermined pressure and rotatably driven, and a gear train to transmit the drive force of the conveyance roller to the discharge rollers 40 and 41.

The discharge rollers 40 and 41 are mounted on the platen 34. The sheet discharge roller 40, which is on a downstream side in the conveyance direction of the sheet P, is provided with a plurality of rubber portions 401 around a metal shaft. The drive force from the conveyance roller 36 is transmitted to and drives the sheet discharge roller 40 via an idler gear 364. The discharge roller 41, which is arranged on an upstream side of the discharge roller 40, is provided with a plurality of elastomer elastic members on a plastic shaft. The drive force to the discharge roller 41 is transmitted from the discharge roller 40 via an idler gear provided on the platen 34.

A cassette 81 provided on the front face of the apparatus accommodates the sheets P. To separate and feed the sheets P, the cassette 81 has a pressure plate 822 that stacks the sheet P and abuts on the feeding roller 821. A base 84 of the apparatus body is provided with the feeding roller 821 for feeding the sheets P, a separation roller which has the same function as the above-described feeding unit for separating the sheets P, a return lever 824 for returning the sheets P to the stack position, and a member for applying pressure on the pressure plate 822.

A movable side guide 827 is provided on the cassette 81 so as to regulate the stacking position of the sheet P. The pressure plate 822 is rotatable around a rotating shaft coupled to the cassette 81. The pressure plate 822 is urged toward the sheet feeding roller 821 by a pressure member 825, which is configured from a pressure plate spring and which is arranged on the base 84. A part of the pressure plate 822 facing the feeding roller 821 is provided with a separation sheet to prevent duplicate sheets P from being fed at one time near the end of stacking. This separation sheet is formed from a material having a large friction coefficient, such as artificial leather. The pressure plate 822 can engage with and disengage from the feeding roller 821 by a pressure plate cam.

On the base 84, a separation roller holder having a separation roller to separate sheets P one at a time is rotatable about a rotating shaft mounted to the base 84, and is urged toward the feeding roller 821 by a separation roller spring. The separation roller 831 includes a clutch spring therein that allows the separation roller 831 to rotate when a predetermined load or more is applied. The separation roller can engage with and disengage from the feeding roller 821 by a separation roller release shaft and a control cam. The positions of the pressure plate 822, the return lever 824, and the separation roller 831 are detected by a UT sensor.

The cleaning unit 6 is configured from a pump 60 to clean the print head 7, a cap 61 to keep the print head 7 from drying, and a blade 62 to clean a surface on a nozzle periphery of the print head 7.

The pump 60 generates a negative pressure by squeezing two tubes with a pump roller. The pump 60 is connected to the cap 61 through a valve. With the cap 61 in hermetic contact with the print head 7, when the pump 60 is activated, unnecessary ink is sucked out from the print head 7. The cap 61 portion is provided with a cap absorbent body to reduce the amount of ink remaining on the surface of the print head 7 after suction. Accordingly, to prevent the ink remaining in the cap absorbent body from solidifying and causing problems, the ink remaining in the cap 61 is sucked out with the cap 61 being open. Waste ink sucked out by the pump 60 is absorbed in a waste ink absorbent body provided in a below-described lower case 99.

The respective units described above are built into the chassis 11 to form the mechanism portion of the printer. An apparatus exterior is arranged to enclose this mechanism portion. The exterior is mainly configured from the lower case 99, an upper case 98, an access cover 97, a front cover 95, and side covers 96. The front cover 95 can accommodate the discharge tray 46. When the printing apparatus is not in use, a paper discharge opening is closed. A sensor detects whether the front cover 95 is open or closed. The access cover 97 is rotatably attached to the upper case 98. The upper case 98 has an opening in a part of its top surface, through which the ink tanks 71 and the print head 7 can be replaced. Further, to detect the opening and closing of the access cover 97, the upper case 98 has a door switch lever, a light-emitting diode (LED) guide to transmit and display LED light, and a key switch 983 to act on a switch of the circuit board. The upper case 98 also has the feed tray 26 rotatably mounted thereon. When the feeding unit is not in use, if the feed tray 26 is retracted, it can be used as a cover of the feeding unit. The upper case 98 and the lower case 99 are assembled by elastic engagement claws. The side covers 96 are mounted so as to enclose the upper case 98 and the lower case 99 from the left and right.

The control unit 10 has a controller board mounted with a central processing unit (CPU), a memory, and various input/output (I/O) interfaces. The control unit 10 controls the functions of the overall printing apparatus. The power source unit 12 supplies power to each of the units in the printing apparatus.

Next, the characteristic portions of the present exemplary embodiment will be described using FIGS. 6 to 12.

Figure 11:
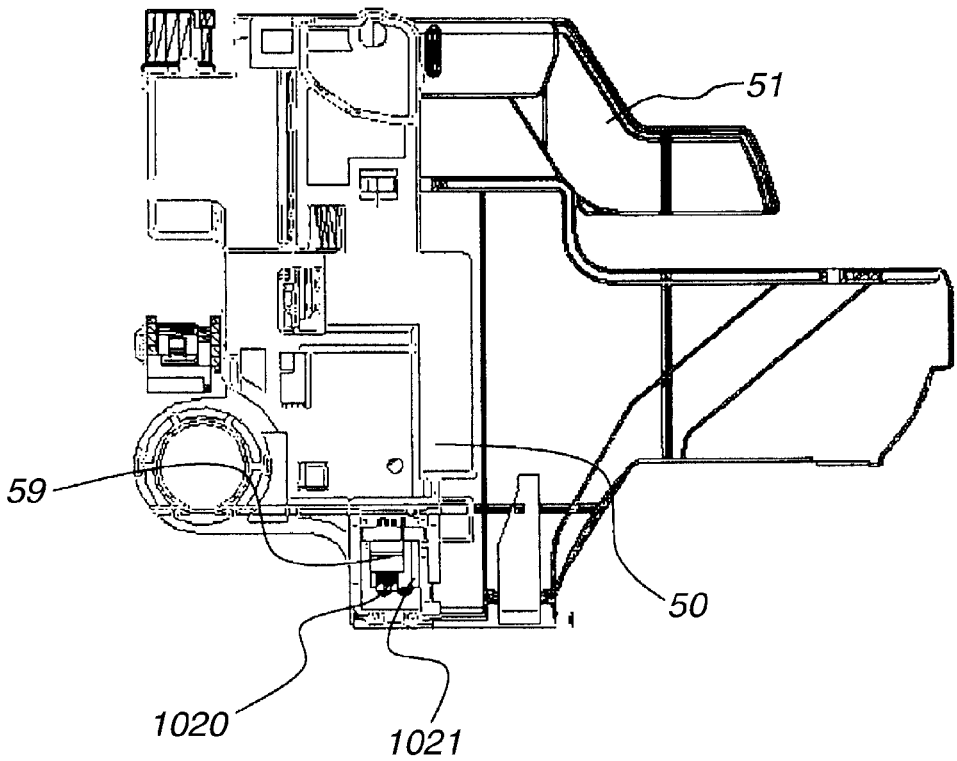
FIG. 11 illustrates a mechanism unit which includes a direct sensor in detail.

FIG. 11 is aside view of a periphery of a direct sensor 59 mounted on a carriage. The basic configuration and sensing principles of a direct sensor 1000 (first direct sensor) and the direct sensor 59 (second direct sensor) are the same.

Figure 6:
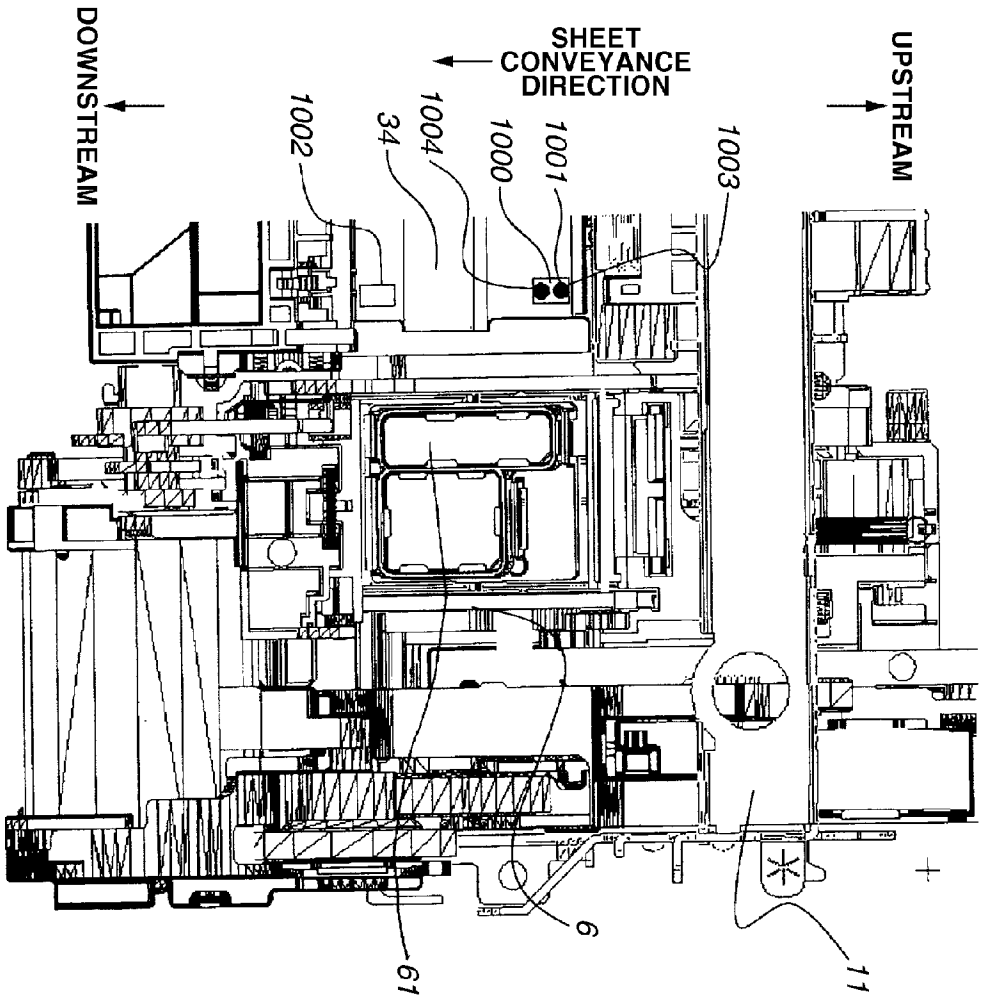
FIG. 6 illustrates a mechanism unit which includes a direct sensor in detail.

In FIG. 6, the platen 34 is provided with openings 1001 and 1002, which penetrate through the platen 34 as holes. As is described below, the direct sensor 1000 can selectively move to a position corresponding to either of these openings 1001 and 1002. Therefore, a part of the direct sensor 1000 can be seen at a lower portion from the sheet supporting surface side of the platen 34 through either the opening 1001 or 1002. In other words, a back surface of the sheet supported by the sheet supporting surface side of the platen 34 (face on the opposite side of the printing surface) can be seen from the direct sensor 1000.

A plurality of nozzles (a nozzle array (discharge port array)) corresponding to different colors is arranged on the print head 7 in the sheet conveyance direction. When the direct sensor 1000 is positioned on the opening 1001, sheet movement can be sensed on the side which is further upstream in the sheet conveyance direction than the nozzle on the farthest upstream side in the sheet conveyance direction among the plurality of nozzles constituting the nozzle array. On the other hand, when the direct sensor 1000 is positioned on the opening 1002, sheet movement can be sensed on the side which is further downstream in the sheet conveyance direction than the nozzle on the farthest downstream side in the sheet conveyance direction among such plurality of nozzles.

FIG. 6 illustrates a state where the direct sensor 1000 beneath the platen is positioned corresponding to the opening 1001 on the upstream side in the sheet conveyance direction. The direct sensor 1000 is formed as a unit by a laser light-emitting element 1003, an image pickup device 1004, and a signal processing unit (an analog-to-digital (AD) converter and an analog front end). The laser wavelength of the laser light-emitting element 1003 is 0.5 to 2 μm. The direct sensor 1000 performs a calculation by imaging a region illuminated by the emitted laser light at fixed time intervals with the image pickup device 1004, and processing an output signal of the image pickup device 1004. The image pickup device 1004 may be a charge coupled device (CCD) sensor or a complementary metal oxide semiconductor (CMOS) sensor. Even for a sheet having a high degree of flatness, such as glossy paper, the movement distance can be correctly obtained. The resolution of the movement distance detection of the sheet surface is $1/3600$ inch. The direct sensor may also use a light-emitting element such as an LED or an organic LED (OLED) instead of the laser light-emitting element.

Figure 24:
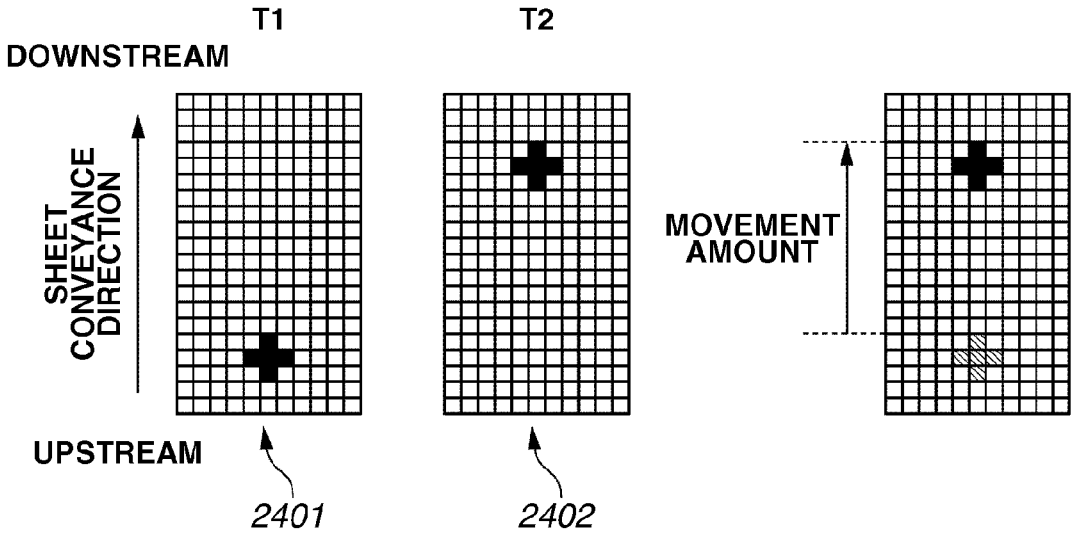
FIG. 24 is a schematic diagram illustrating an order in which movement is sensed by signal processing of image data.
Figure 25:
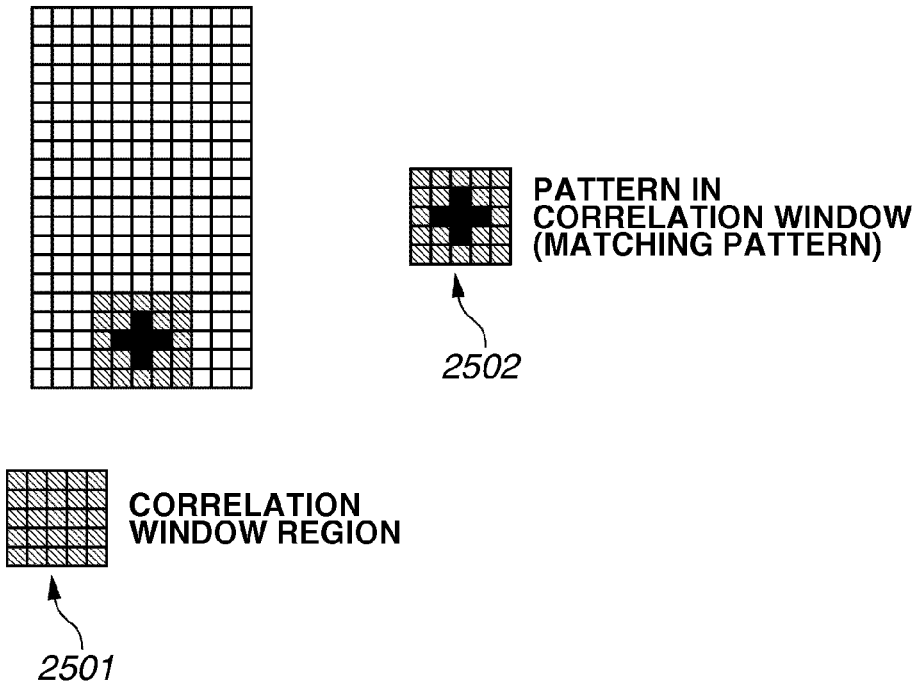
FIG. 25 illustrates extraction of a pattern in a correlation window.

FIGS. 24 and 25 illustrate the movement sensing principles of the direct sensor. FIG. 24 is a schematic diagram illustrating the procedures in which movement is sensed based on acquired image information. FIG. 25 illustrates extraction of a pattern in a correlation window. In FIG. 24, first image data 2401 is obtained from a sheet surface acquired at an arbitrary time T1. In FIG. 24, first image data 2401 is obtained from a sheet surface acquired at an arbitrary time T1. With respect to this image, image data in a specific region 2501 (correlation window region) of FIG. 25 is stored as a pattern 2502 in a correlation window. Next, second image data 2402 is obtained at a time T2 different from time T1. It is then determined by image correlation processing at which region of the second image data 2402, the pattern 2502 in a correlation window is present. By considering the optical magnification, if the size of the region on the paper surface captured by the image pickup device is found, movement of the sheet can be sensed from the movement on the image of the pattern in a correlation window. The movement speed of the sheet can also be obtained using information about the acquired sheet conveyance amount and the time difference when the image to be compared was acquired. The signal processing for sensing movement based on the image data acquired by the image pickup device is performed by the control unit 10. As a modified example, this processing may also be performed by a signal processing unit in the direct sensor unit.

The present exemplary embodiment is not limited to a direct sensor which senses movement by image processing based on image data acquired by an image pickup device. A principle is known that reflected light from a moving object changes in frequency due to Doppler shift based on a change in the movement speed of the moving object. The movement speed of an object can be directly sensed by illuminating a sense position of the object with a laser, obtaining the change in frequency by detecting the reflected light with an optical sensor, and performing signal processing. Further, a Doppler sensing method direct sensor may also be used. Namely, any kind of direct sensor may be used, as long as such sensor directly senses movement of the sheet by optically detecting the surface of the sheet.

Figure 7:
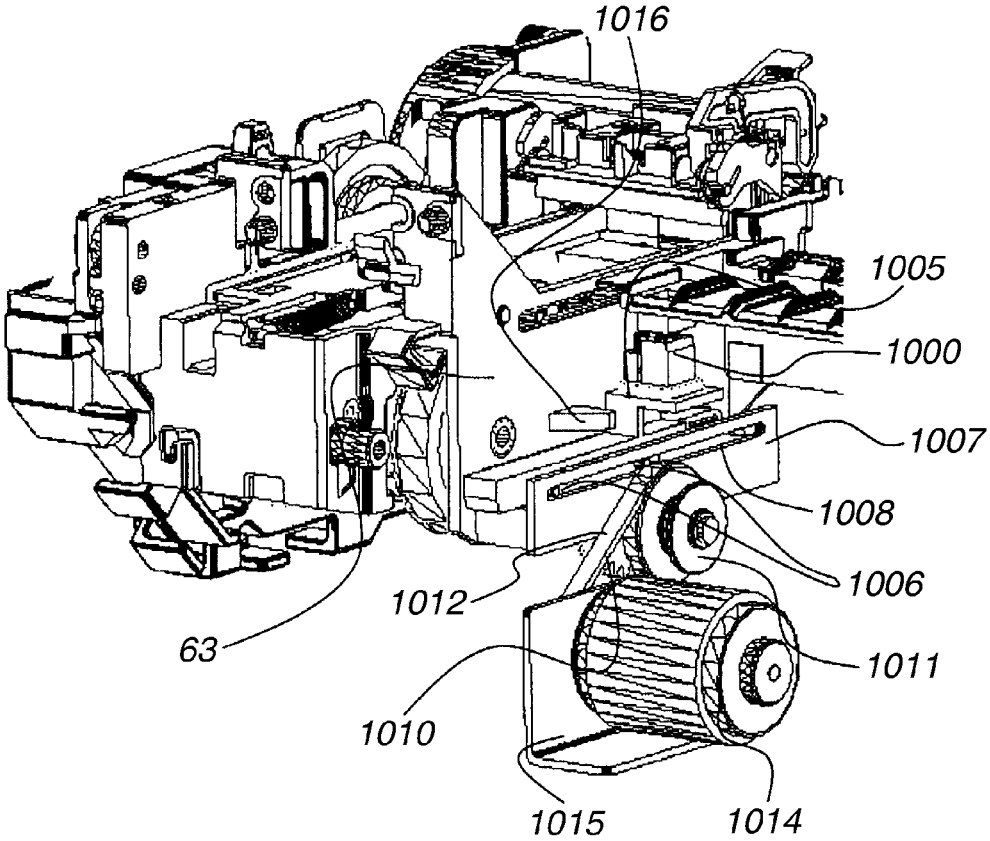
FIG. 7 illustrates a mechanism unit which includes a direct sensor in detail.
Figure 8:
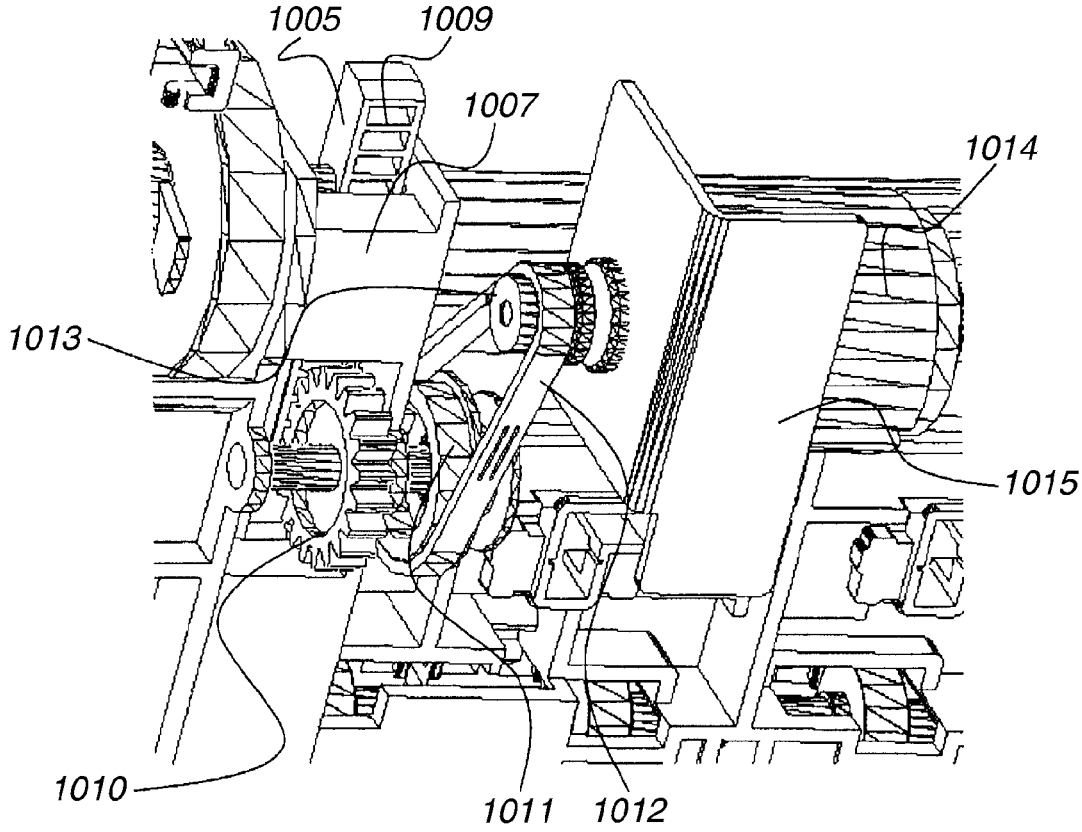
FIG. 8 illustrates a mechanism unit which includes a direct sensor in detail.

In FIGS. 7 and 8, the direct sensor 1000 is fixed to a sensor holder 1005 which can move in the sheet conveyance direction. A total of four guide bosses 1006, which allow the direct sensor 1000 to slide, protrude on both side surfaces of the 1005. These guide bosses engage with slide holes 1008 provided on a sensor slide guide 1007 and with similarly-shaped opposing holes which are provided on a cleaning base 63. This configuration allows the sensor holder 1005 and the direct sensor 1000 to slide 25 mm. A rack 1009 is integrally formed on a lower portion of the sensor holder 1005. A pinion 1010 engages with this rack 1009. The pinion 1010 is supported by a shaft on the cleaning base 63 and the sensor slide guide 1007. A belt pulley 1011 is fixed to an end of that shaft. A belt 1012 is wound between the belt pulley 1011 and a motor pulley 1013 which is press-fit into the shaft of a motor 1014. The motor 1014 is screwed into a motor bracket 1015, and the motor bracket 1015 is screwed into the base 20.

Figure 9:
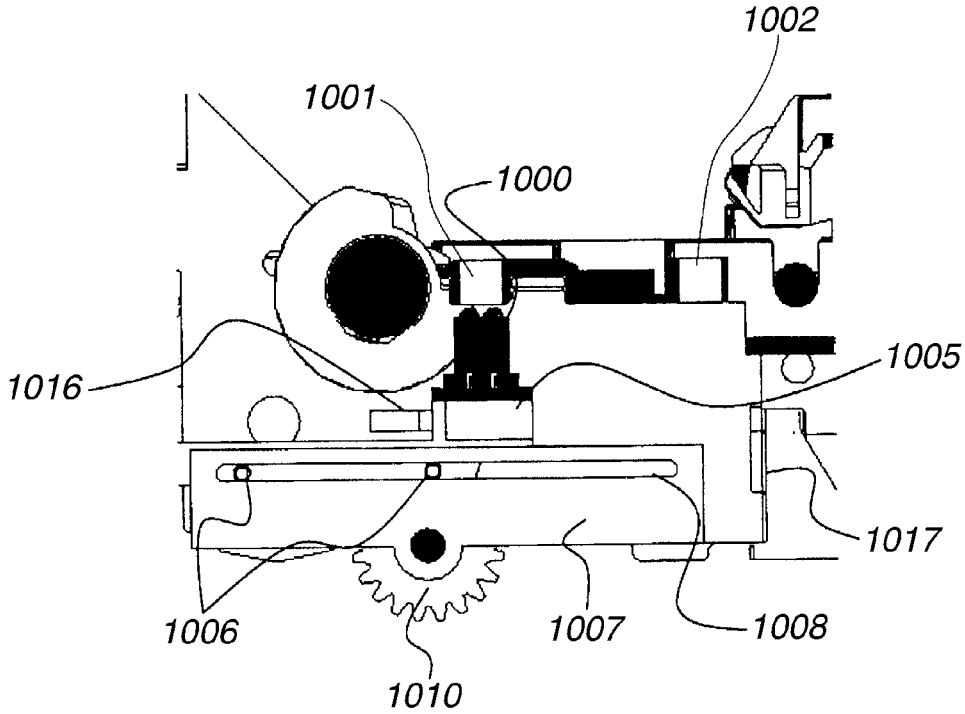
FIG. 9 illustrates a mechanism unit which includes a direct sensor in detail.
Figure 10:
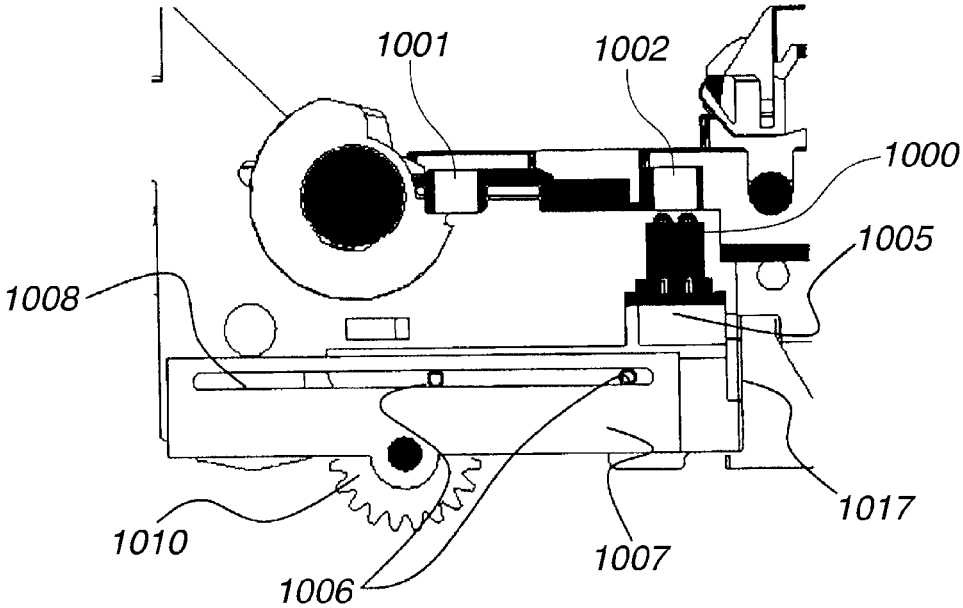
FIG. 10 illustrates a mechanism unit which includes a direct sensor in detail.

In the state illustrated in FIG. 9, the sensor holder 1005 is stopped at a position where it strikes a first stopper 1016 provided on the cleaning base 63. From this state, if the motor 1014 is driven so that the pinion 1010 rotates in a clockwise direction, the sensor holder 1005 and the direct sensor 1000 move to the downstream side in the sheet conveyance direction. As a result, as illustrated in FIG. 10, the sensor holder 1005 is stopped at a position where it strikes a second stopper 1017. In the present exemplary embodiment, since the sensor holder 1005 is stopped during printing by abutting portions at two locations, on the upstream side and on the downstream side in the sheet conveyance direction, a feedback control using a motor rotary encoder is not performed.

The openings 1001 and 1002 in the present exemplary embodiment are arranged in the sheet conveyance direction (predetermined direction), and the direct sensor 1000 is also movable in the same direction. However, the present exemplary embodiment is not limited to this. The openings and the sensor may be movable at an angle to the conveyance direction. Namely, the direct sensor 1000 may be movable in a direction which is parallel to the surface of the sheet, including a sheet conveyance direction component, and the openings 1001 and 1002 may also be formed in the same direction. Further, the number of openings is not limited to two. Three or more openings may be provided, and the direct sensor 1000 may be configured so that it can selectively move to a position corresponding to any of these openings.

In FIG. 11, the direct sensor 59 provided on the carriage 50 is formed from a laser light-emitting element 1020, an image pickup device 1021, and a signal processing unit (an AD converter and an analog front end). The position of the optical axis of the direct sensor 59 is further upstream in the sheet conveyance direction than the nozzle array of the print head 7. This position is roughly the same position as illustrated in FIG. 9 when the direct sensor 1000 beneath the platen has moved to the upstream side in the sheet conveyance direction. When the carriage 50 performs a scanning movement at a position where the direct sensor 59 surfaces the paper surface, and during the scanning movement, the sheet such as a sheet of printing paper is conveyed, the conveyance distance can be calculated by extracting only the movement distance in the sub-scanning direction from the data read by the direct sensor 59.

The direct sensor 1000 beneath the platen (first direct sensor) and the direct sensor 59 above the carriage (second direct sensor) are used in various combinations based on the printing mode.

In a case of a mode in which printing is performed in both directions of the reciprocal scanning movement (reciprocating path) of the carriage 50, during acceleration and deceleration of the carriage, one line's worth of conveyance has to be finished. Therefore, in a two-way printing mode, the conveyance amount is not detected by the direct sensor 59, but only by the direct sensor 1000 beneath the platen. However, if the following method is carried out, the conveyance amount can be detected even by the direct sensor 59. Namely, at the expense of printing speed, after the carriage 50 decelerates, the carriage is temporarily returned until the direct sensor 59 surfaces the upper surface of the sheet to be printed. Then, the conveyance amount is detected by conveying the sheet, the carriage is again returned to the acceleration start position (deceleration finish position), and the carriage scanning movement is started.

Further, due to differences in conveyance resistance between the left and the right, the conveyance amounts on the left and right edges in the width direction of the sheet P (both edges of the sheet in an orthogonal direction to the sheet conveyance direction) do not perfectly match, and there is a difference between them. Especially during printing from the leading edge to the middle of the sheet, when the trailing edge of a long sheet of A4 or larger remains in the feeding unit path, differences in conveyance resistance between the left and the right tend to be produced by the ASF and U-turn path shape. Thus, a white streak, a black streak, or image unevenness can be produced on only one side. For an apparatus or printing mode which places priority on image quality over printing speed, the conveyance amounts on the left and right edges of the sheet are detected and the conveyance amount is controlled based on an average thereof, so that a printing apparatus can be realized which suppresses image defects on both the left and the right of the sheet.

For one-way printing (performing printing only during reciprocal scanning), only one line's worth of sheet conveyance has to be finished during the carriage return. Therefore, if one line of conveyance is finished while the carriage is performing a scanning movement near the non-reference side (side opposite to the cleaning unit), the approximate conveyance amounts on the sheet left and right can be detected by matching with the output of the direct sensor 1000 beneath the platen. In the present exemplary embodiment, as to a sheet with a size of A4 or larger, control is performed together with the direct sensor 59 only in regions other than the trailing edge during one-way printing.

Thus, how the two direct sensors are used can be determined based on the requirements of printing speed and image quality in each printing mode.

Next, the sequence of apparatus operations will be described using the flowchart of FIG. 12. These apparatus operations are executed by control from the control unit 10.

Figure 12:
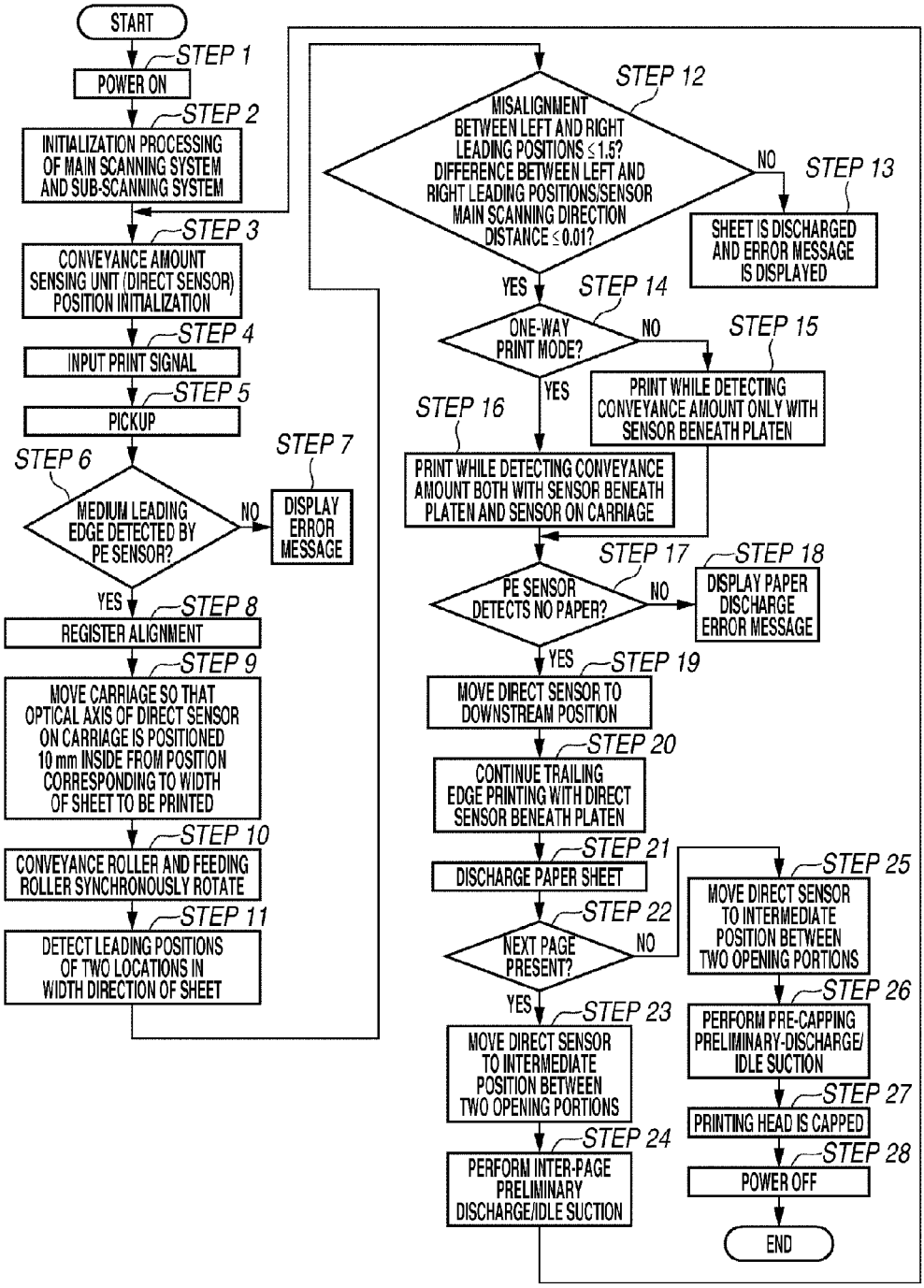
FIG. 12 is a flowchart illustrating a sequence of apparatus operations.

As illustrated in FIG. 12, in step S1, when the power is turned ON, the processing proceeds to step S2. In step S2, the printing apparatus checks the ASF sensor and the PE sensor, and based on the checked state, the main scanning system (carriage scanning system) and the sub-scanning system (sheet conveyance system) are initialized.

Next, in step S3, the position of the direct sensor 1000 beneath the platen is initialized. More specifically, the motor 1014 is driven so as to move the direct sensor 1000 in a direction toward the upstream side in the conveyance direction so that the sensor holder 1005 strikes the first stopper 1016. In a normal finish state, the sensor holder 1005 is positioned on the upstream side in the conveyance direction. However, the sensor holder 1005 can be reliably placed at the initialization position driven by the motor, which moves the sensor holder just by an amount equivalent to a fixed distance.

In step S4, when a printing signal is input from an external host device, such as a personal computer, the processing proceeds to step S5. In step S5, a sheet P is picked up from the feeding unit to be separated one at a time by the separation roller, and fed. In step S6, passage of the leading edge of the sheet P is detected by the PE sensor. If passage of the leading edge is detected (YES in step S6), the processing proceeds to step S8. If passage of the leading edge is not detected (NO in step S6), the printing apparatus determines that a "no paper" or a "paper jam" state has occurred, and the processing proceeds to step S7. In step S7, the feeding operation is stopped, and an error message is displayed by the LED on the exterior.

Next, in step S8, a registration is performed to prevent skew-feeding of the sheet P with the leading edge of the sheet P abutting on the stopped conveyance roller 36 and producing a loop. In step S9, the carriage 50 is moved from an edge position on the opposite side of the cleaning unit 6 so that the optical axis of the direct sensor 59 is positioned 10 mm in from a position corresponding to the width of the sheet set by the print signal. In step S10, the conveyance roller 36 and the feeding roller 821 are synchronously rotated at roughly the same rotation speed. During the synchronous rotation, the separation roller 831 is released, and the loop is eliminated.

While the sheet P is being conveyed to the print start position, a conveyance distance from a position where the sheet P leading edge enters a position facing the direct sensors 59 and 1000, to the print start position where the sheet P stops is calculated based on data obtained by the direct sensors 59 and 1000.

In step S11, since the absolute positions of the direct sensor 1000 and the direct sensor 59 are known, based on these calculated values the leading position (leading edge position of the sheet) for setting the sheet leading edge in two locations in the width direction of the sheet P is detected. In step S12, it is determined whether the leading positions on both the left and the right in the width direction of the sheet is more than ±1.5 mm from a predetermined position, or whether a value obtained by dividing the difference between the left and right leading positions in the width direction of the sheet by the main scanning direction distance between the two direct sensors 1000 and 59 is more than 0.01. By performing these calculations, it is determined whether the sheet leading edge state is good or not. As a result, in step S13, when the calculated values exceed the predetermined values (NO in step S12), printing is stopped, the sheet is discharged, and an error message prompting a user to reset or re-feed the sheet is displayed on a driver screen on the personal computer. As a result of this process, problems with the sheet leading edge state, such as a very curled sheet, a leading position defect caused by a sheet setting problem, or skew-feeding can be determined, which can prevent printing troubles in advance.

In step S14, it is determined whether the print mode is a one-way print mode. If it is determined that the print mode is a two-way direction print mode (NO in step S14), the processing proceeds to step S15. In step S15, printing is performed while detecting the sheet conveyance amount only with the direct sensor 1000 beneath the platen.

In step S16, printing is performed while repeating one-way carriage scanning movement and line advancement of the sheet by the conveyance roller. At this stage, the sheet conveyance amount is detected both with the direct sensor 1000 and the direct sensor 59, and the conveyance amount is controlled based on the average of these conveyance amounts. Since both the direct sensor 1000 and direct sensor 59 are positioned further upstream in the sheet conveyance direction than the print start position, the sheet leading edge portion can be directly sensed.

Further, at start of printing, since the sheet P is already positioned above the direct sensor 1000, deterioration in the detection function can be prevented, which occurs when an ink mist discharged from the print head adheres to the direct sensor 1000 and smears the lens.

In step S17, printing is continued, and the PE sensor detects the timing of when the trailing edge of the sheet P passes. The size of the sheet P is input beforehand from a personal computer. Thus, in step S18, if the sheet trailing edge is not detected even after conveyance is performed by 1.5 times the predetermined amount after detection of the sheet leading edge by the PE sensor (NO in step S17), the printing apparatus displays a paper discharge error message that prompts the user to perform an appropriate action.

After performing the feeding operation in which the trailing edge of the sheet P passes the PE sensor, in step S19, the motor 1014 is driven so that the direct sensor 1000 moves to a position facing the opening 1002 on the downstream side in the sheet conveyance direction. By moving the direct sensor 1000 in this manner, the sheet P is positioned above the direct sensor 1000 until printing of the trailing edge is finished. Consequently, as described above, deterioration in the detection function of the sensor can be prevented. When printing the trailing edge, in step S20, the conveyance amount control is performed based on only the direct sensor 1000. As described above, the position information of the sheet in the conveyance direction is acquired by the PE sensor. Based on this position information, during a print job of one sheet, the direct sensor 1000 (image pickup device) is moved from the upstream side to the downstream side by the movement mechanism, and the sensing position is changed.

In step S21, when the printing finishes and a discharge paper sheet signal is input, the sheet is discharged. In step S22, it is determined whether a next page is present. If it is determined that a next page is present (YES in step S22), the processing proceeds to step S23. In step S23, the direct sensor 1000 is moved to an intermediate position between the opening 1001 and the opening 1002. Then, in step S24, inter-page preliminary discharge/idle suction is performed. The processing then returns to step S3, and the operations from initializing the position of the direct sensor are repeated.

If it is determined that a next page is not present (NO in step S22), the processing proceeds to step S25. In step S25, the direct sensor 1000 is similarly moved to an intermediate position between the opening 1001 and the opening 1002. Then, in step S26, pre-capping preliminary-discharge/idle suction is performed. In step S27, the print head is capped. In step S28, the power is turned OFF, and the above operations are finished.

Various preliminary discharges are carried out in the cap 61 as a maintenance operation of the print head in order to perform good printing. Further, to prevent ink from overflowing in the cap, idle suction is performed in a state where the print head 7 is not engaged with the cap 61. As illustrated in FIG. 6, at this stage, because the cap 61 and the direct sensor 1000 are positioned close to each other, if preliminary discharge is carried out in a state where the sheet has not yet come, an ink mist can enter via an opening and smear the direct sensor 1000. To prevent this, during preliminary discharge, the direct sensor 1000 is moved to an intermediate position between the opening 1001 and opening 1002 so that the direct sensor 1000 cannot be seen from either of the openings.

While a case was described above in which printing is performed by feeding from a feeding unit, the operations are similar when printing by feeding the sheet from the above-described U-turn/automatic two-sided conveying unit to the conveyance unit. Thus, a description thereof will be omitted here.

In the present exemplary embodiment, the direct sensor 1000 is moved upon detection of the trailing edge of the sheet P by the PE sensor as a trigger. However, the present exemplary embodiment is not limited to this. This movement timing may also be determined by a combination of leading edge detection by the direct sensor 1000 or PE sensor and the sheet length data. Further, this movement may be performed at any time after the leading edge of the sheet P has passed the position of the direct sensor 1000, at timing where the conveyance amount can be detected during printing of the trailing edge.

In the present exemplary embodiment, when the sheet P is facing the direct sensor 1000 or the direct sensor 59, the conveyance amount of the sheet is controlled based on a detection output of these sensors. During a sensing disabled period (feeding period or paper sheet discharge period) where the sheet P is not facing these sensors, the conveyance motor 35 is controlled based on detection information obtained by the encoder sensor 363 of the conveyance unit reading a slit on the code wheel 362. However, the present exemplary embodiment is not limited to this control method. A method may be used in which, after the sheet P faces the direct sensor 1000 or the direct sensor 59, a difference between the conveyance amount detected by the direct sensor 1000 or the direct sensor 59 and the conveyance amount detected by the encoder sensor 363 may be stored in a memory as a correction value. When using this memory method, the actual conveyance is controlled based on a conveyance amount obtained by adding the above-described correction value to the conveyance amount detected by the encoder sensor 363. This correction value is different between the period during which the sheet is held on the conveyance roller 36 and the period during which the sheet trailing edge leaves the conveyance roller 36 and is conveyed by the two discharge rollers 40 and 41. Therefore, a method may also be used in which individual correction values are set before and after the timing when the sheet leaves the conveyance roller 36, and the respective values are stored in the memory. During printing, since the kind of sheet and the printing mode are designated by the printer driver, the correction value may be set based on such factors, and for the next printing, the correction value stored for the previous time in the memory may be used.

In the present exemplary embodiment, the conveyance amount of the sheet is controlled based on an output sensed by the direct sensors. However, the present exemplary embodiment is not limited to this. For example, the print timing of the print head when forming the image may be changed based on the sensing by the direct sensors so as to cancel a localized change in the conveyance amount or conveyance speed. Further, the image data for driving the print head may itself be changed based on the sensing by the direct sensors so as to cancel a localized change in the conveyance amount or conveyance speed. Namely, a good image can be obtained by either method as long as at least one of the conveyance mechanism and the print head is controlled based on an output from the direct sensors so that an influence of the conveyance accuracy of the conveyance mechanism on the print image is reduced. This can also be said as to the other exemplary embodiments described below.

In the present exemplary embodiment, the sensing position is changed by moving the direct sensors in the sheet conveyance direction. However, the present exemplary embodiment is not limited to this. For example, the sensing position may also be changed by providing a direct sensor at each of a plurality of sensing positions, and switching the direct sensor used for the sensing. This can also be said as to the other exemplary embodiments described below.

A second exemplary embodiment of the present invention will now be described using FIGS. 13 to 16. Here, only the characteristic portions of the present exemplary embodiment will be described. Parts with the same function/shape as the first exemplary embodiment are denoted with the same reference numeral.

Figure 13:
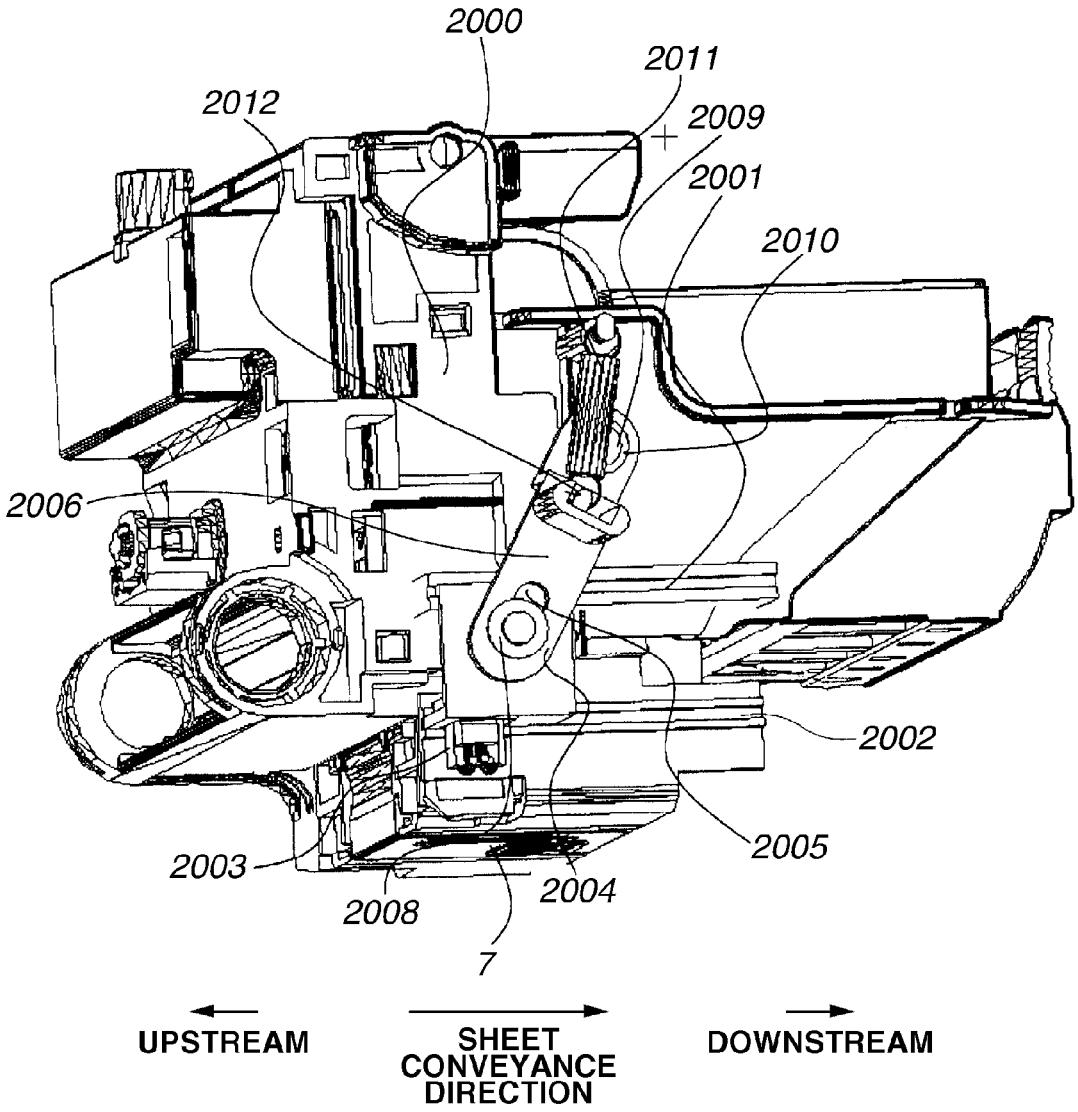
FIG. 13 is a perspective view illustrating a carriage unit according to a second exemplary embodiment.

FIG. 13 is a perspective view of a carriage unit. Similar to the first exemplary embodiment, a carriage 2000 mounts the print head 7 and configures a printing unit. A slide guide groove A2001 and slide guide groove B2002 are integrally provided on the sides surfaces of the carriage 2000. A carriage sensor holder 2004 is engaged with these two grooves A2001 and B2002, and is movably guided along both of these grooves. A direct sensor 2003 is fixed to the carriage sensor holder 2004. This direct sensor 2003 is the same as the direct sensor 59 in the first exemplary embodiment.

A boss 2005 protrudes from the carriage sensor holder 2004. An elongated hole 2007 of a swing arm 2006 is engaged with this boss 2005, and the swing arm 2006 is prevented by a stopper ring 2008 from being pulled out. The swing arm 2006 can rotate around a rotating center shaft 2009, which protrudes from the carriage 2000, and the swing arm 2006 is prevented by a stopper ring 2010 from being pulled off. A spring 2011 is provided between the carriage 2000 and the swing arm 2006. In the state illustrated in FIG. 13, this spring 2011 pulls the swing arm 2006 in a direction which urges the swing arm 2006 in a clockwise direction. The carriage sensor holder 2004 is moved by that urging towards the left side in the drawing illustrated in FIG. 13 (upstream side in the sheet conveyance direction), and is stopped by abutting on a stopper on the carriage.

Figure 16A:
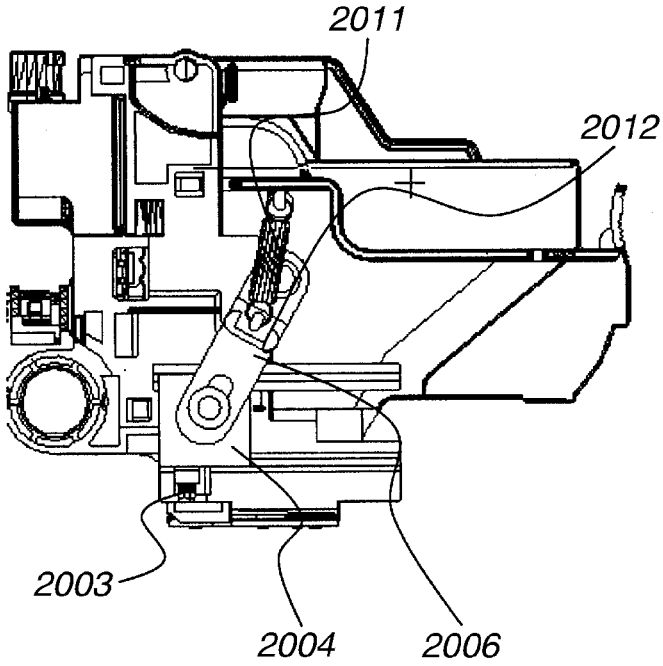
FIGS. 16A and 16B illustrate operation of a swing arm.
Figure 16B:
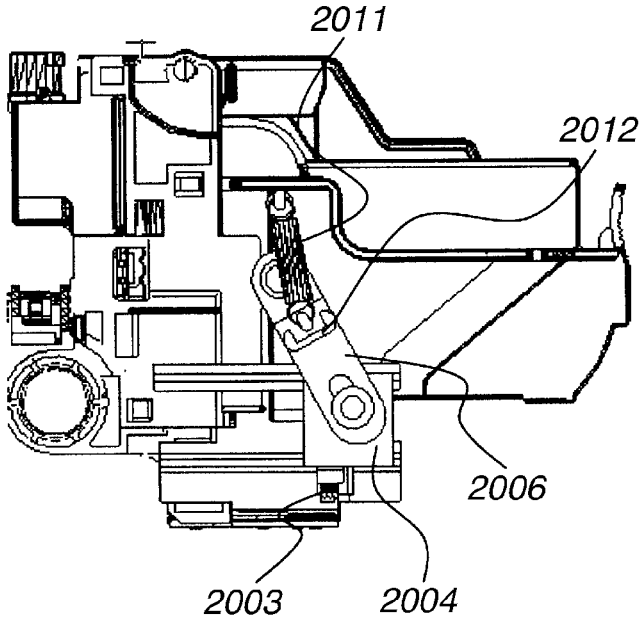

A protrusion 2012 is integrally provided on the swing arm 2006. This protrusion 2012 is pushed in an opposite direction to that of the above-described urging direction by a below-described lever guide 2013 contacting a cylindrical shape to the left and right thereof. This results in the swing arm 2006 rotating and the swing arm 2006 is stopped when it strikes a position on the opposite side. Thus, the carriage sensor holder 2004 can move to a plurality of locations on the left and right of the drawing illustrated in FIG. 13. Further, the carriage sensor holder 2004 is positioned without any rattling as a result of the urging by the spring. FIG. 16 illustrates a state where the direct sensor 2003 has moved to a plurality of locations (two locations) on the upstream side (FIG. 16(*a*)) and downstream side (FIG. (b)) in the conveyance direction.

Figure 14:
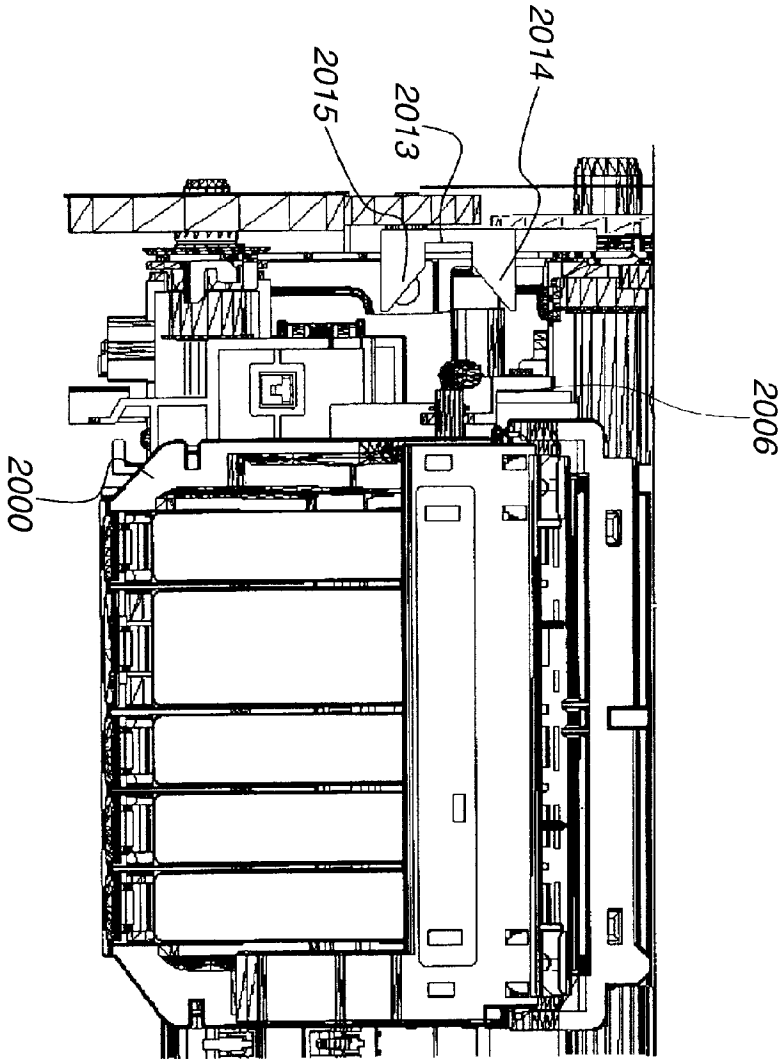
FIG. 14 is a top view illustrating a state just before a protrusion contacts a lever guide.

FIG. 14 is a top view of just before the protrusion 2012 contacts the lever guide 2013. A description of the same parts as in the first exemplary embodiment will be omitted here. The lever guide 2013 is fixed by a screw to the chassis 11. Two tapered portions 2014 and 2015 are integrally provided on the lever guide 2013. As illustrated in FIG. 14, if the carriage moves to the non-reference side (side opposite to the cleaning unit of the printing apparatus in the carriage scanning direction), the protrusion 2012 contacts the tapered portion 2014 or 2015. As a result, the swing arm 2006 rotates in the opposite direction, and as described above, the carriage sensor holder 2004 moves to either of two positions on the left or right in the drawing illustrated in FIG. 13.

Figure 15:
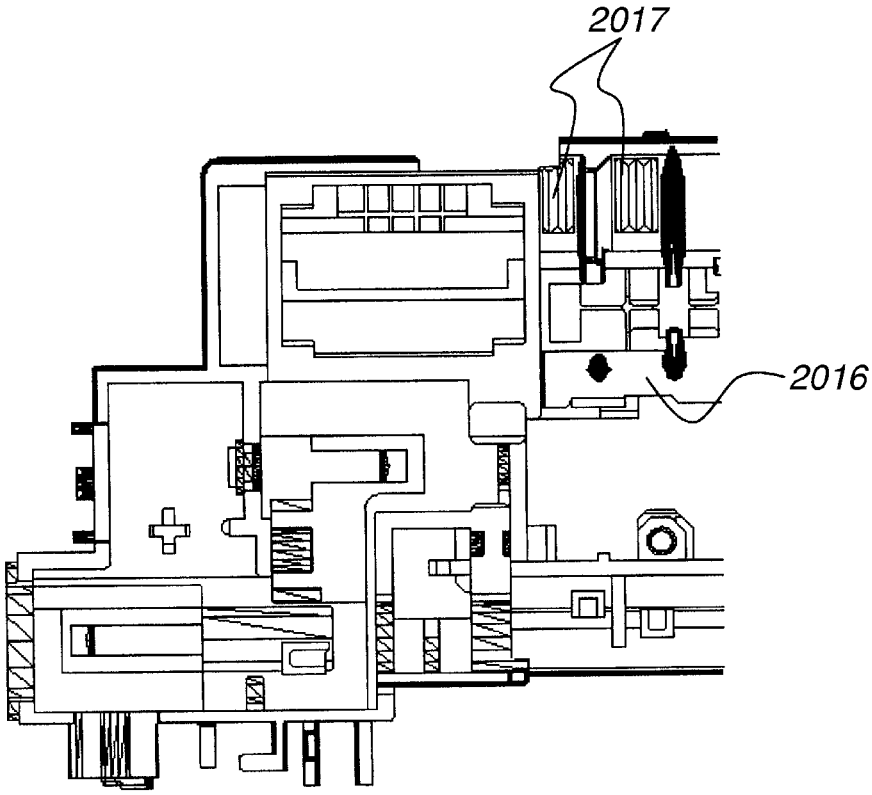
FIG. 15 is a top view illustrating a non-reference side of a platen.

FIG. 15 is a top view of the non-reference side of the platen according to the present exemplary embodiment. In FIG. 15, a sensor position determination unit 2017 having a cross-section of a saw shape is formed on the upstream side in the sheet conveyance direction of a platen 2016. When the direct sensor 2003 is positioned on the upstream side in the sheet conveyance direction, the optical axis of the direct sensor 2003 faces the sensor position determination unit 2017. Since laser light is diffusely reflected due to the saw shape, a unique light receiving pattern appears when the light is received while the carriage 2000 is performing a scanning movement above the sensor position determination unit 2017.

On the other hand, if the scanning movement is performed when the direct sensor 2003 is positioned on the downstream side in the sheet conveyance direction, light is reflected from a flat portion. Thus, the resultant pattern is different from the pattern which appears when the direct sensor 2003 is positioned on the upstream side in the sheet conveyance direction. Therefore, while the carriage is performing a scanning movement, it can be determined whether the direct sensor 2003 is positioned on the upstream side or the downstream side in the sheet conveyance direction by detecting the sensor signal.

Figure 17:
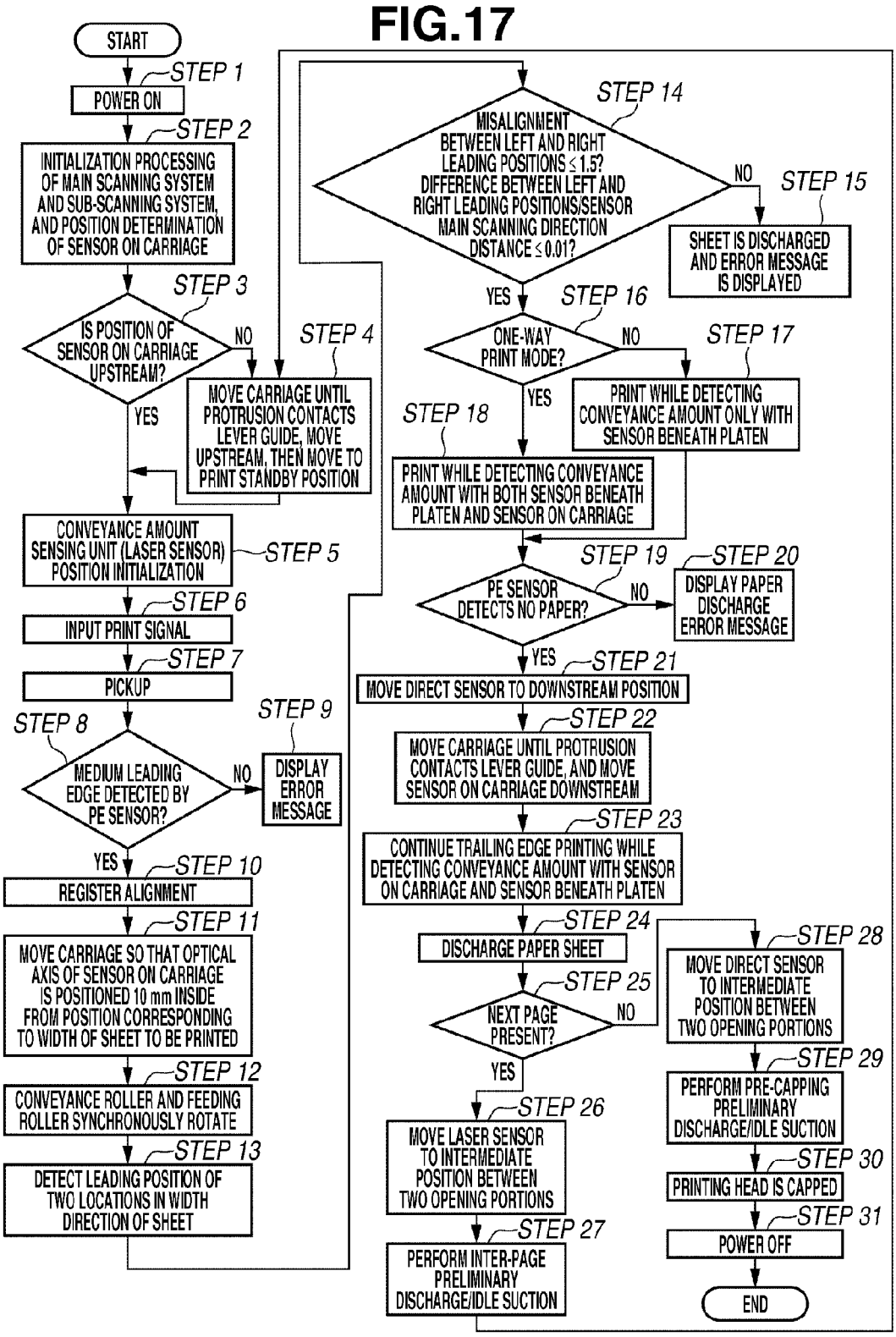
FIG. 17 is a flowchart illustrating a sequence of apparatus operations.

The operation sequence of the present exemplary embodiment will now be described using the flowchart of FIG. 17. In step S1, when the power is turned ON, the processing proceeds to step S2. In step S2, the printing apparatus checks the ASF sensor and the PE sensor, and based on the checked state, the main scanning system and the sub-scanning system are initialized. At this stage, since the carriage 2000 passes a main scanning position corresponding to the sensor position determination unit 2017, the sensor position determination is also performed. Then, in step S3, it is determined whether the sensor position on the carriage (position of the direct sensor 2003) is on the upstream side in the sheet conveyance direction. If it is determined that the sensor position is on the upstream side in the conveyance direction (YES in step S3), the processing proceeds to step S4. In step S4, the carriage 2000 is moved to the non-reference side until the protrusion 2012 contacts the lever guide 2013. The direct sensor 2003 is moved to the upstream side in the sheet conveyance direction and then the carriage 2000 is moved to a print standby position.

Next, in step S5, the position of the direct sensor 1000 beneath the platen is initialized. In step S6, when a printing signal is input from a personal computer, the processing proceeds to step S7. In step S7, the sheet P is picked up from the feeding unit to be separated one at a time by the separation roller, and fed. In step S8, passage of the leading edge of the sheet P is detected by the PE sensor. If passage of the leading edge is detected (YES in step S8), the processing proceeds to step S10. If passage of the leading edge is not detected (NO in step S8), the printing apparatus determines that a "no paper" or a "paper jam" state has occurred, and the processing proceeds to step S9. In step S9, the feeding operation is stopped, and an error message is displayed by the LED on the exterior.

In step S10, a registration is performed to prevent skew-feeding of the sheet P with the leading edge of the sheet P abutting on the stopped conveyance roller 36 and producing a loop. In step S11, the carriage 2000 is moved from an edge position on the opposite side of the cleaning unit so that the optical axis of the direct sensor 2003 is positioned 10 mm in from a position corresponding to the width of the sheet set by the print signal. In step S12, the conveyance roller 36 and the feeding roller 821 are synchronously rotated at roughly the same rotation speed. During the synchronous rotation, the separation roller 831 is released, and the loop is eliminated.

While the sheet P is being conveyed to the print start position, a conveyance distance from a position where the sheet P leading edge enters a position facing the direct sensors 1000 and 2003 to the print start position where the sheet P stops is calculated based on data obtained by the direct sensors 1000 and 2003.

In step S13, since the absolute positions of the direct sensors 1000 and 2003 are known, based on these calculated values the leading position (leading edge position of the sheet) for setting the sheet leading edge in two locations in the width direction of the sheet P is detected. In step S14, it is determined whether the leading positions on both the left and the right in the width direction of the sheet is more than ±1.5 mm from a predetermined position, or whether a value obtained by dividing the difference between the left and right leading positions in the width direction of the sheet by the main scanning direction distance between the two direct sensors 1000 and 2003 is more than 0.01. By performing these calculations, it is determined whether the sheet leading edge state is good or not. As a result, in step S15, when the calculated values exceed the predetermined values (NO in step S14), printing is stopped, the sheet is discharged, and an error message prompting a user to reset or re-feed the sheet is displayed on a driver screen on the personal computer.

In step S16, it is determined whether the print mode is a one-way print mode. If it is determined that the print mode is a two-way direction print mode (NO in step S16), the processing proceeds to step S17. In step S17, printing is performed while detecting the sheet conveyance amount only with the direct sensor 1000 beneath the platen.

In step S18, printing is performed while repeating one-way carriage scanning movement and line advancement of the sheet by the conveyance roller. At this stage, the sheet conveyance amount is detected both with the direct sensor 1000 and the direct sensor 2003, and the conveyance amount is controlled based on the average of these conveyance amounts.

In step S19, printing is continued, and the PE sensor detects the timing of when the trailing edge of the sheet P passes. Since the size of the sheet P is input beforehand from a personal computer, in step S20, if the sheet trailing edge is not detected even after conveyance is performed by 1.5 times the predetermined amount after detection of the sheet leading edge by the PE sensor (NO in step S19), the printing apparatus displays a paper discharge error message that prompts the user to perform an appropriate action.

After the operation for feeding the trailing edge of the sheet P past the PE sensor has been performed, in step S21, the motor 1014 is driven so that the direct sensor 1000 moves to a position facing the opening 1002 on the downstream side in the sheet conveyance direction. Then, in step S22, the carriage 2000 is moved to the non-reference side until the protrusion 2012 contacts the lever guide 2013, and the direct sensor 2003 is moved to the downstream side in the sheet conveyance direction. In step S23, the conveyance amount is detected by both the direct sensor 1000 and the direct sensor 2003, and the conveyance amount is controlled based on an average conveyance amount thereof. Since the conveyance amount is controlled based on an average value while detecting the conveyance amounts on both the left and right in the width direction of the sheet across all regions of the sheet from the leading edge to the trailing edge of the sheet, high quality printing can be realized. As described above, the position information of the sheet in the conveyance direction is acquired by the PE sensor. Based on this position information, during a print job of one sheet, the direct sensors 1000 and 2003 are respectively moved from the upstream side to the downstream side by the movement mechanism.

In step S24, when the printing finishes and a discharge paper sheet signal is input, the sheet is discharged. In step S25, it is determined whether a next page is present. If it is determined that a next page is present (YES in step S25), the processing proceeds to step S26. In step S26, the direct sensor 1000 is moved to an intermediate position between the opening 1001 and the opening 1002. Then, in step S27, inter-page preliminary discharge/idle suction is performed. The processing then returns to step S3, and the operations from initializing the position of the direct sensor are repeated. If it is determined that a next page is not present (NO in step S25), the processing proceeds to step S28. In step S28, the direct sensor 1000 is similarly moved to an intermediate position between the opening 1001 and the opening 1002. Then, in step S29, pre-capping preliminary-discharge/idle suction is performed. In step S30, the print head is capped. In step S31, the power is turned OFF, and the above operations are finished.

In the present exemplary embodiment, as a position detection technique of the direct sensor 2003, it is determined whether the direct sensor 2003 is on the upstream side or the downstream side in the sheet conveyance direction by detecting a reflected light sensor signal from the platen side. However, the present exemplary embodiment is not limited to this. For example, a method may be employed in which the position of the member holding the direct sensor 2003 is detected using a mechanical switch or an optical sensor. Further, this position detection sensor may be provided on the carriage, or on the printing apparatus body side. In addition, a method may be employed in which the direct sensor 2003 is operated in a similar manner to the direct sensor 1000 using a motor or a solenoid.

Figure 18:
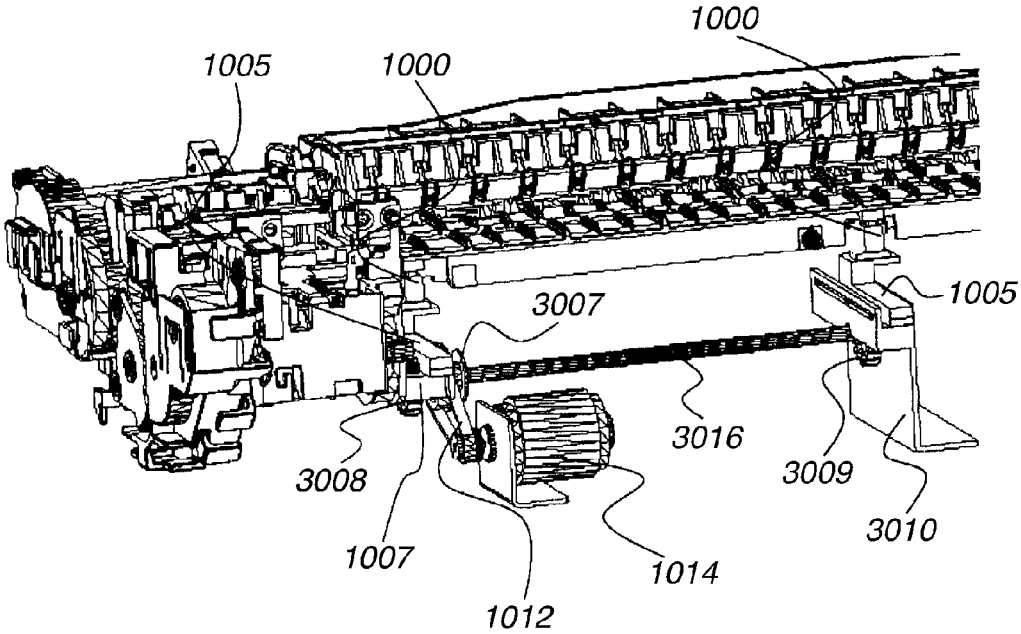
FIG. 18 is a perspective view illustrating a sensor according to a third exemplary embodiment.
Figure 19:
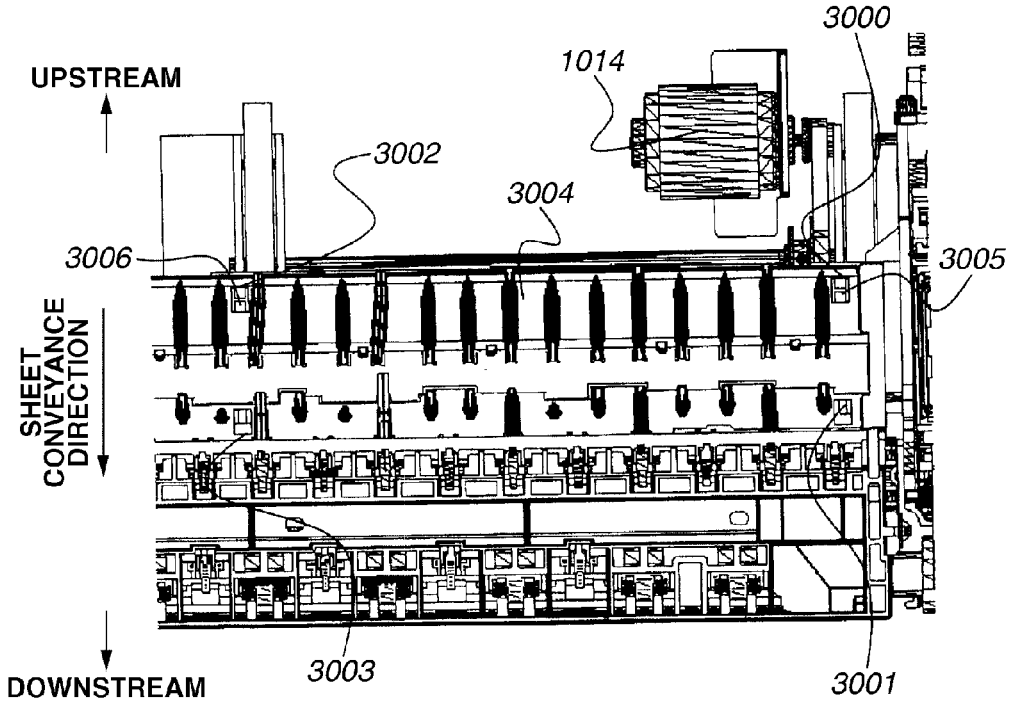
FIG. 19 is a top view illustrating a platen.

A third exemplary embodiment will now be described using FIGS. 18 and 19. FIG. 18 is a perspective view illustrating a direct sensor beneath a platen for directly sensing sheet movement. FIG. 19 is a top view of the platen according to the present exemplary embodiment. Parts which are the same as the first exemplary embodiment are denoted with the same reference numeral. In FIG. 19, four openings, 3000, 3001, 3002, and 3003 are formed on a platen 3004. Similarly to the first exemplary embodiment, the opening 3000 is provided at a position which is further upstream than the nozzle which is on the farthest upstream side in the sheet conveyance direction among the nozzle array of the print head. The opening 3001 is provided at a position which is further downstream than the nozzle which is on the farthest downstream side in the sheet conveyance direction among this nozzle array.

The opening 3002 is positioned 123.5 mm apart from the opening 3000 on the non-reference side, and the opening 3003 is positioned a further 25 mm apart in the sheet conveyance direction. In the state illustrated in FIG. 19, a first direct sensor 3005 is exposed from the opening 3000, and a second direct sensor 3006 is exposed from the opening 3002.

In FIGS. 18 and 19, similar to the first exemplary embodiment, the motor 1014 is driven so that the first direct sensor 3005 can move in the sheet conveyance direction.

A difference with the first exemplary embodiment is that a pinion 3008 and a pinion shaft 3016 can be fixed on a shaft coaxially with a belt pulley 3007 and can integrally rotate with the belt pulley 3007 from the left and right of the drawing illustrated in FIG. 18. Drive force of the motor 1014 is transmitted via the belt 1012 and the belt pulley 3007 to a pinion unit 3009 which is integral with the pinion 3008 and the pinion shaft 3016. Two sensor holders 1005 with the same shape are mounted on the left and right of the drawing in FIG. 18 (on both sides in the main scanning direction of the printing apparatus), and direct sensors 1000 are respectively mounted on an upper part. The sensor slide guide 1007 which guides each of the sensor holders 1005 and allows the sensor holders 1005 to move in the sheet conveyance direction is fixed to the base of the apparatus.

According to the above-described configuration, if the motor 1014 is rotated and driven, the two direct sensors 3005 and 3006 move simultaneously. The direct sensors 3005 and 3006 are each positioned 2 to 5 mm in from the width of a sheet of L-sized photographic glossy paper. From this configuration, the detection of the leading position carried out in the first exemplary embodiment using both the direct sensor 1000 and the direct sensor 59 can be performed by the two direct sensors 3005 and 3006.

Concerning the pitch in the main scanning direction of the direct sensors 3005 and 3006, when detecting the leading position of an A4 size sheet, the detection accuracy increases if the pitch is equivalent to 200 mm. However, when direct sensors are used, resolution is high. Accordingly, such sensors can be appropriately used to detect skew-feeding even in a case of a width equivalent to L-size.

In the present exemplary embodiment, for an L size width, control can be performed based on the conveyance amounts on both the left and the right in the width direction of the sheet across all regions of the sheet from the leading edge to the trailing edge of the sheet. Further, similar to the first and second exemplary embodiments, the conveyance amounts on the left and the right in the width direction of the sheet are detected, and control can be performed based on the detection results, without any deterioration in the printing speed. Therefore, a printing apparatus can be realized which has high image quality without problems such as a white streak, a black streak, or image unevenness produced on only one side of the sheet.

Further to the above-described exemplary embodiment, when the size of the sheet to be used is definite, such as L size and A4, the conveyance amount detection sensor (direct sensor beneath the platen) may be provided at three or more locations. Further, based on image quality requirements, the apparatus may also be configured so that only one sensor on the reference side is movable in the conveyance direction, and the remaining sensors are fixed beneath the platen. These configurations are also included in the scope of the present invention.

Figure 20:
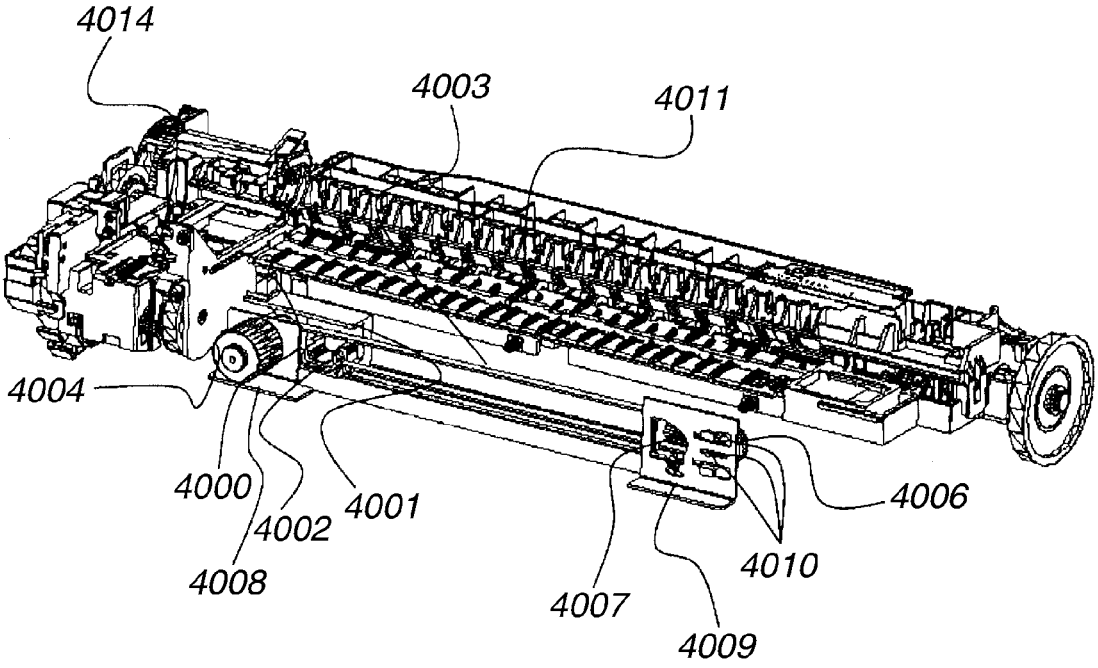
FIG. 20 is a perspective view illustrating a printing apparatus according to a fourth exemplary embodiment.
Figure 21:
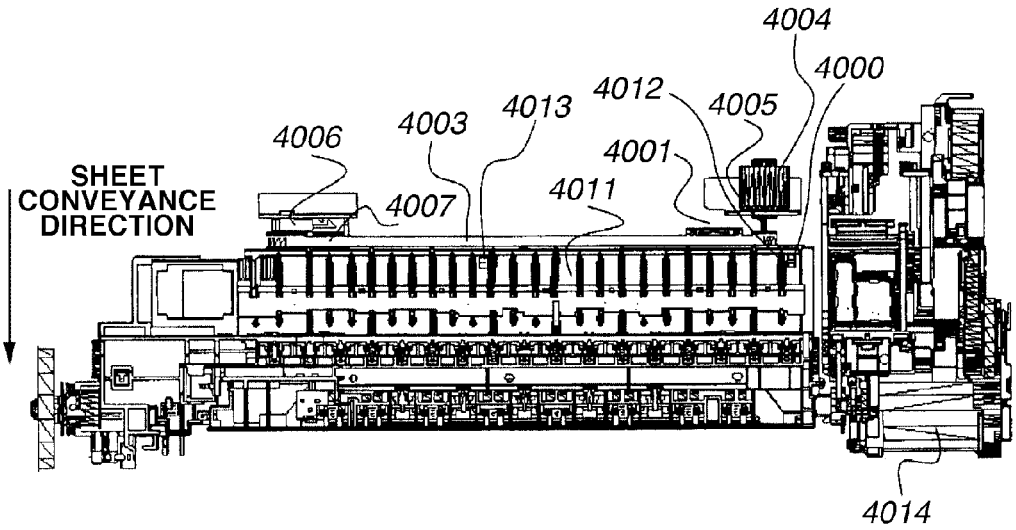
FIG. 21 is a top view illustrating a state where a direct sensor is moving.
Figure 22:
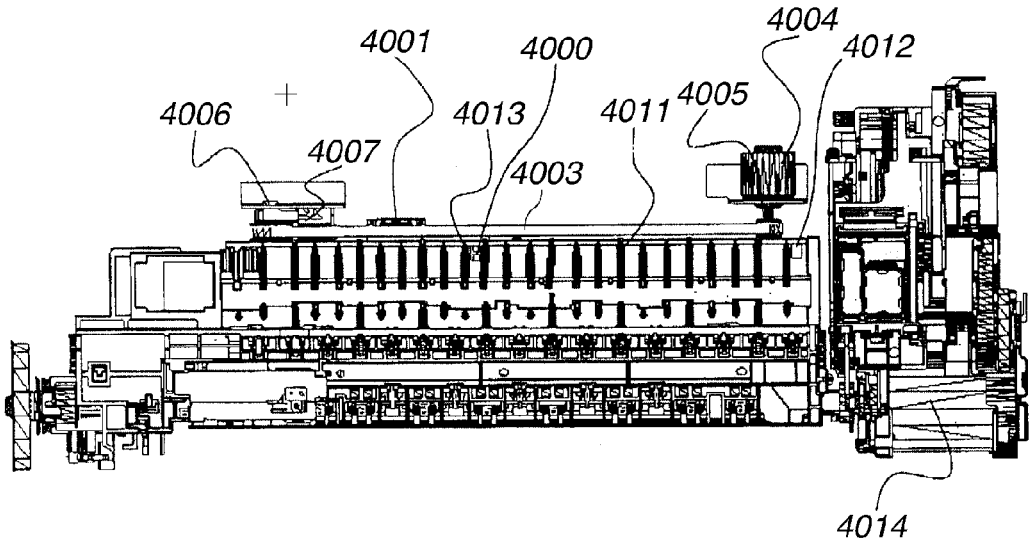
FIG. 22 is a top view illustrating a state where a direct sensor is moving.
Figure 23:
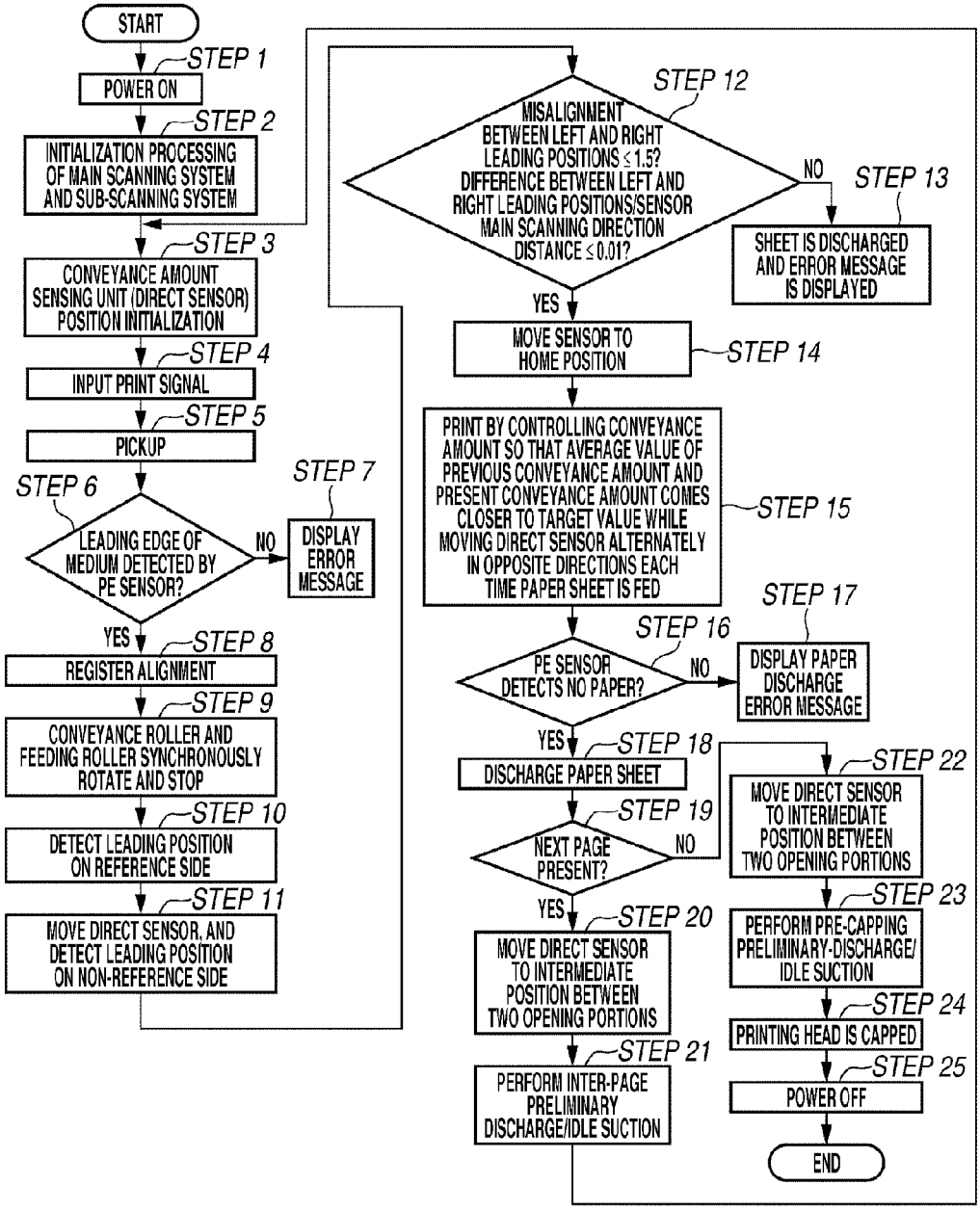
FIG. 23 is a flowchart illustrating a sequence of apparatus operations.

FIG. 20 is a perspective view illustrating a fourth exemplary embodiment. FIGS. 21 and 22 are top perspective views as seen from the upstream side in the sheet conveyance direction of a platen periphery, illustrating a state where a direct sensor beneath the platen is moving to two locations in the main scanning direction. For ease of understanding, only the essential parts are illustrated. FIG. 23 is a flowchart illustrating an operation sequence of the fourth exemplary embodiment.

In FIGS. 20 to 23, a direct sensor 4000 is the same part as that in the first to third exemplary embodiments. The direct sensor 4000 is fixed to a sensor holder 4001. A belt stopper 4002 into which a belt 4003 is inserted and fixed is integrally provided on the sensor holder 4001. The belt 4003 is wrapped around a pulley 4005 which is press-fit on a shaft of a stepping motor 4004 provided adjacent to a cleaning unit 6. The other end of the belt 4003 is wrapped around an idler pulley 4006. The idler pulley 4006 is urged in the left direction of FIG. 21 by a tension spring 4007, whereby a fixed tension is applied on the belt 4003. The stepping motor 4004 is fixed to a motor bracket 4008. The idler pulley 4006 is guided by three slits 4010 opened on a pulley bracket 4009, thereby being slidably supported in the main scanning direction.

Two openings 4012 and 4013 are provided on a platen 4011, so that the sensor holder 4001 can be seen from the sheet supporting surface side of the platen. The two openings 4012 and 4013 are 121.5 mm apart. A shielding flag is integrally provided on the sensor holder 4001. The home position (position in FIG. 21) of the sensor holder 4001 is determined by a photosensor being shielded by this shielding flag. Four protrusions are provided on the sensor holder 4001. The sensor holder 4001 is guided and can move in the main scanning direction as a result of these protrusions fitting into a slide groove of a sensor holder guide.

The sensor holder 4001 moves in the main scanning direction by rotating and driving the stepping motor 4004, whereby the direct sensor 4000 is exposed from either the opening 4012 or opening 4013 (respectively, FIGS. 21 and 22). Since an L size sheet has a width of 127 mm, as to sheets having a width equal to or greater than L size, the conveyance amount at the two locations of the left and the right in the width direction of the sheet can be sensed. Other structures are the same as those of the first exemplary embodiment, and thus a description thereof is omitted here.

Next, the operation sequence of the present exemplary embodiment will be described using FIG. 23. Concerning operations which are the same as in the first exemplary embodiment, only a brief description will be given.

As illustrated in FIG. 23, in step S1, when the power is turned ON, the processing proceeds to step S2. In step S2, the printing apparatus initializes the main scanning system and the sub-scanning system. Next, in step S3, the position in the main scanning direction of the direct sensor beneath the platen is initialized. More specifically, the direct sensor 4000 is moved 10 mm toward the non-reference side, then moved toward the reference side. The sensor holder 4001 stops at a position (home position) 3 mm from the position where the shielding flag of the sensor holder 4001 shields the photosensor. By performing this action, the sensor holder 4001 can be positioned at the home position (position in FIG. 21) no matter where the sensor holder 4001 is.

In step S4, when a printing signal is input from an external host device, such as a personal computer, the processing proceeds to step S5. In step S5, the sheet P is picked up from the feeding unit to be separated one at a time by the separation roller, and fed. In step S6, passage of the leading edge of the sheet P is detected by the PE sensor. If passage of the leading edge is detected (YES in step S6), the processing proceeds to step S8. If passage of the leading edge is not detected (NO in step S6), the printing apparatus determines that a "no paper" or a "paper jam" state has occurred, and the processing proceeds to step S7. In step S7, the feeding operation is stopped, and an error message is displayed by the LED on the exterior.

In step S8, a registration is performed to prevent skew-feeding of the sheet P with the leading edge of the sheet P abutting on the stopped conveyance roller 36 and producing a loop. In step S9, the conveyance roller 36 and the feeding roller 821 are synchronously rotated at roughly the same rotation speed. During the synchronous rotation, the separation roller 831 is released, and the loop is eliminated.

In step S10, the leading position on the reference side of the sheet P is detected by the direct sensor 4000. At this stage, a conveyance distance from a position where the sheet P leading edge enters a position facing the direct sensor 4000, to the print start position where the sheet P stops is calculated based on data obtained by the direct sensor 4000. Since the absolute position of the direct sensor 4000 is known, based on this calculated value the leading position on the reference side of the sheet P (position on the sheet leading edge side) can be detected.

Next, in step S11, the direct sensor 4000 is moved to the non-reference side (position in FIG. 22), and the leading position is detected by the direct sensor 4000. At this stage, the conveyance roller 36 is temporarily rotated in reverse, so that the leading edge of the sheet P moves to the upstream side in the sheet conveyance direction from the optical axis of the direct sensor 4000. Then, the conveyance roller 36 is once more rotated normally, and the leading position is detected in the same manner as on the reference side. The sheet skew-feeding amount is basically determined at the point of registration. Since this amount does not change after the sheet is held on the conveyance roller, skew-feeding can be detected by this method.

In step S12, it is determined whether the leading positions on the left and the right in the width direction of the sheet is more than ±1.5 mm from a predetermined position, or whether a value obtained by dividing the difference between the left and right leading positions in the width direction of the sheet by the main scanning direction distance of the sensor movement is more than 0.01. As a result, in step S13, when the calculated values exceed the predetermined values (NO in step S12), printing is stopped, the sheet is discharged, and an error message prompting a user to reset or re-feed the sheet is displayed on a driver screen on the personal computer. As a result of this process, problems with the sheet leading edge state, such as a very curled sheet, a leading position defect caused by a sheet setting problem, or skew-feeding can be determined, which can prevent printing troubles in advance.

In step S14, the direct sensor 4000 is returned to the home position on the reference side. Then, in step S15, printing is performed while repeating carriage scanning movement and line advancement by the conveyance roller 36. At this stage, the sheet conveyance amount is detected by the direct sensor 4000, and the actual conveyance amount is controlled based on the detected conveyance amount. Further, the direct sensor 4000 alternately moves to the opposite side each time a sheet is fed. Thus, the conveyance amount is controlled so that the actual conveyance amount comes closer to a target value based on the average value of the previous conveyance amount and the present conveyance amount. By this method, the conveyance amounts on the left and the right in the width direction of the sheet are alternately detected and controlled, whereby a conveyance amount difference between the left and the right in the width direction of the sheet is reduced. As a result, an image in which black streaks and white streaks are not noticeable across the main scanning region can be realized.

Thus, during a print job of one sheet, the image pickup device of the direct sensor 4000 is moved by the movement mechanism, and the sensing position is changed.

In step S16, printing is continued, and the PE sensor detects the timing of when the trailing edge of the sheet P passes. Since the size of the sheet P is input beforehand from a personal computer, in step S17, if the sheet trailing edge is not detected even after conveyance is performed by 1.5 times the predetermined amount after detection of the sheet leading edge detection by the PE sensor (NO in step S17), the printing apparatus displays a paper discharge error message that prompts the user to perform an appropriate action.

In step S18, when the printing finishes and a discharge paper sheet signal is input, the sheet is discharged. In step S19, it is determined whether a next page is present. If it is determined that a next page is present (YES in step S19), the processing proceeds to step S20. In step S20, the direct sensor 4000 is moved to an intermediate position between the opening 4012 and the opening 4013. Then, in step S21, inter-page preliminary discharge/idle suction is performed. The processing then returns to step S3, and the operations from initializing the position of the direct sensor are repeated.

If it is determined that a next page is not present (NO in step S19), the processing proceeds to step S22. In step S22, the direct sensor 4000 is similarly moved to an intermediate position between the opening 4012 and the opening 4013. Then, in step S23, pre-capping preliminary-discharge/idle suction is performed. In step S24, the print head is capped. In step S25, the power is turned OFF, and the above operations are finished. The direct sensor 4000 is moved to an intermediate position which does not correspond to the openings 4012 or 4013 so that an ink mist does not adhere to the sensor during preliminary discharge.

In the present exemplary embodiment, since the sensor is not moved in the sub-scanning direction (sheet conveyance direction), the conveyance amount over all regions of the sheet cannot be detected. However, the present exemplary embodiment is not limited to this configuration. The conveyance amount over all regions from the leading edge to the trailing edge of the sheet can be detected by combining with the first exemplary embodiment, or by providing two movement amount detection sensors in the sub-scanning direction on the sensor holder 4001. Further, detection of the conveyance amount over all regions from the leading edge to the trailing edge of the sheet can also be performed by detecting not both the leading (set) position of the sheet leading edge and the sheet conveyance amount, like in the present exemplary embodiment, but by detecting either one of these.

Further, the movement distance in the main scanning direction of the direct sensor 4000 and the number of openings which expose the direct sensor 4000 are also not limited to the above-described settings. For example, the setting position or conveyance amount may also be detected by providing openings at two locations for a width equivalent to L size and A4 on the platen, and three locations on the reference side, and changing the stop position based on the sheet size. To accurately detect the sheet skew-feeding amount and the conveyance amount difference between left and right in the width direction of the sheet, it is desirable to perform the detection at a position which is closer to the edge in the width direction of the sheet.

In each of the above-described exemplary embodiments, during a print job of one sheet, the sensing position of the direct sensor is changed from the upstream side to the downstream side. Thus, the sensing disabled period of the direct sensor can be reduced more. In addition, sensing can also be performed by a direct sensor across all regions of a single sheet during conveyance.

Further, during printing of a sheet edge portion, sensing can be performed by a direct sensor if the sheet edge portion is positioned directly under any of the plurality of nozzle arrays of the print head arranged in the conveyance direction. If, for example, the direct sensor did not move in the sheet conveyance direction, a sensing disabled period would occur during the printing of the sheet trailing edge or leading edge. Namely, according to the above exemplary embodiments, sensing can be performed using the direct sensor across all regions of the sheet during printing, which can form a good image, including the sheet edges portions.

In addition, the present invention also provides the following advantageous effects.

There is no need for a large-diameter encoder wheel to ensure conveyance accuracy, and direct sensing can be performed by a direct sensor across all regions of the sheet. As a result, a compact printing apparatus capable of high-quality image output can be realized.

There is no need to reduce an amount of the sheet leading edge/trailing edge regions conveyed at one time to ensure conveyance accuracy. This means that the conveyance amount including the sheet leading edge and trailing edge can be increased and that printing speed can be increased, which can realize a printing apparatus that outputs high-quality images in a short printing time.

The conveyance mechanism does not need to have a high degree of accuracy or a high friction coefficient across all regions, including the sheet leading edge and trailing edge. Thus, a printing apparatus can be realized which is inexpensive and has excellent productivity.

The movement of the sheet leading edge and trailing edge can be sensed by a single image pickup device. Accordingly, an inexpensive and high-quality printing apparatus can be realized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-236776 filed Sep. 16, 2008, which is hereby incorporated by reference herein in its entirety.

What is claimed is:

1. A printing apparatus comprising:

a conveyance mechanism configured to convey a sheet in a predetermined direction;

a printing unit including a print head and configured to print an image on the sheet conveyed by the conveyance mechanism;

a sensor having an image pickup device provided under a printing region of the print head and configured to image a sheet surface that is on a side opposite to a printing surface of the sheet on which an image is formed by the print head;

a platen including a plurality of openings at different locations in the predetermined direction and configured to support a sheet conveyed by the conveyance mechanism, wherein the plurality of openings are located such that the image pickup device can image a sheet surface of the conveyed sheet through any one of the plurality of openings;

a movement mechanism configured to move the image pickup device to any one of a plurality of positions corresponding to the plurality of openings; and a control unit configured to control the movement mechanism such that the image pickup device moves to a position which does not correspond to any of the plurality of openings when performing a maintenance operation of the print head.

2. The printing apparatus according to claim 1, wherein the control unit is configured to perform control so that, during a print job of one sheet, the image pickup device is moved by the movement mechanism.

3. The printing apparatus according to claim 1, wherein the sensor is a movement sensing sensor, the printer apparatus further comprising:

a sheet position sensor configured to sense the sheet in the predetermined direction; and an acquiring unit configured to acquire the sheet position in the predetermined direction based on sensing a trailing edge of the conveyed sheet with the sheet position sensor.

4. The printing apparatus according to claim 1, wherein the printing unit can reciprocally move in a direction intersecting the predetermined direction along a surface of the sheet, and wherein the control unit is configured to perform control so that an image is printed on the sheet by alternately repeating sheet conveyance with the conveyance mechanism and movement of the carriage.

5. The printing apparatus according to claim 1 wherein the printing unit has a carriage which mounts the print head and which can reciprocally move in a direction intersecting the predetermined direction along a surface of the sheet, wherein the sensor has a plurality of the image pickup devices, wherein each image pickup device is arranged in a position that faces the carriage and is arranged in the direction in which the carriage moves, wherein the movement mechanism is configured to move at least one image pickup device of the plurality of image pickup devices in the predetermined direction in which the sheet in conveyed, and wherein, in response to the sheet being fed below the print head, the control unit performs control so that a sheet leading edge of the sheet is detected using the plurality of image pickup devices, and a leading position of the sheet is calculated based on detection of the sheet leading edge.

6. The printing apparatus according to claim 1, wherein the printing unit has a carriage which mounts the print head and which can reciprocally move in a direction intersecting the predetermined direction along a surface of the sheet, wherein the sensor has a plurality of image pickup devices, wherein each image pickup device is arranged in a positions that faces the carriage and is arranged in the direction in which the carriage moves, wherein the movement mechanism is configured to move at least one image pickup device of the plurality of image pickup devices in the predetermined direction in which the sheet is conveyed, and wherein the control unit is configured to control the conveyance mechanism based on an average value of conveyance amount sensed corresponding to each image pickup device of the plurality of image pickup devices.

7. The printing apparatus according to claim 1, wherein the conveyance mechanism has a roller and an encoder configured to detect rotation of the roller, and wherein the control unit is configured to control the movement mechanism by using a correction value calculated on both an output obtained from the encoder and movement sensed by the sensor.

8. The printing apparatus according to claim 1, wherein the printing unit comprises an inkjet print head having a plurality of nozzle arrays arranged in the predetermined direction.

9. The printing apparatus according to claim 1, wherein the sensor is positioned in a sensor holder and the sensor holder is stopped during printing by abutting portions at one of two locations.

10. The printing apparatus according to claim 1, wherein a position of an optical axis of the sensor is further upstream in a sheet conveyance direction than a nozzle array of a print head included in the printing unit.

11. The printing apparatus according to claim 1, wherein, in response to performing a feeding operation in which a trailing edge of the conveyed sheet passes a PE sensor, the image pickup device is moved by the movement mechanism from the upstream side towards the downstream side in the predetermined direction so ink mist discharged from the printing unit does not adhere to the image pickup device.

12. The printing apparatus according to claim 11, wherein, in response to determining that a next page is present, the image pickup device is moved to an intermediate position between a first opening in a platen of the printing apparatus and a second opening in the platen of the printing apparatus.

13. The printing apparatus according to claim 1, wherein the plurality of openings includes a first opening on the upstream side in the predetermined direction and a second opening on the downstream side in the predetermined direction, and wherein, during the movement of the image pickup device by the movement mechanism from the upstream side to the downstream side in the predetermined direction, the image pickup device passes from the first opening to the second opening.

14. The printing apparatus according to claim 13, wherein, in response to determining printing of a first sheet is finished and determining whether a second sheet is present, the image pickup device is moved by the movement mechanism to an intermediate position between the first opening and the second opening whereby an ink mist from the printing unit cannot smear the image pickup device.

15. The printing apparatus according to claim 1, wherein the print head performs preliminary discharge as the maintenance operation of the print head.

16. A printing apparatus comprising:

a conveyance mechanism configured to convey a sheet in a predetermined direction;

a printing unit including a carriage which mounts a print head and which can reciprocally move in a direction intersecting the predetermined direction along a surface of the sheet, and configured to print an image on the conveyed by the conveyance mechanism;

a sensor including a first image pickup device configured to image a sheet surface of the conveyed sheet that is on a side opposite to a printing surface of the sheet on which an image is formed by the print head and a second image pickup device configured to image the printing surface; and a control unit configured to control at least one of the conveyance mechanism and the printing unit based on conveyance amount sensed only with the first image pickup in response to determining that a print mode of the printing apparatus is a two-way direction print mode and control at least one of the conveyance mechanism and the printing unit based on conveyance amount sensed with both the first image pickup and the second image pickup in response to determining that the print mode is a one-way direction printing mode.

17. The printing apparatus according to claim 16, wherein the first image pickup device is provided on a cleaning unit side adjacent to a cleaning unit of the printing apparatus and the second image pickup device is provided on a non-reference side of the printing apparatus that is opposite to the cleaning unit.

18. The printing apparatus according to claim 16, wherein, in response to determining that the print mode is the one-way direction print mode and the sheet is a sheet with a size of A4 or large, the control unit is configured to perform together with the sensor only in regions other than a trailing edge of the sheet.

19. The printing apparatus according to claim 16, wherein, in the one-way direction printing mode, printing by the print head is performed while repeating one-way carriage scanning movement and a conveyance of the sheet by the conveyance mechanism, and wherein, in the two-way direction printing mode, printing by the print head is performed in both directions of reciprocal scanning movement of the carriage.

* * * * *